US011167299B2

(12) United States Patent
Santagiuliana

(10) Patent No.: US 11,167,299 B2
(45) Date of Patent: Nov. 9, 2021

(54) SYSTEM FOR DISPENSING FLUIDS OR MIXTURES AND DEVICE USED IN SAID SYSTEM

(71) Applicant: TAPLAST s.r.l., Vicenza (IT)

(72) Inventor: Evans Santagiuliana, Vicenza (IT)

(73) Assignee: TAPLAST s.r.l.

( * ) Notice: Subject to any disclaimer, the term of this patent is extended or adjusted under 35 U.S.C. 154(b) by 0 days.

(21) Appl. No.: 16/755,633

(22) PCT Filed: Oct. 3, 2018

(86) PCT No.: PCT/IB2018/057687
§ 371 (c)(1),
(2) Date: Apr. 13, 2020

(87) PCT Pub. No.: WO2019/073338
PCT Pub. Date: Apr. 18, 2019

(65) Prior Publication Data

US 2020/0331014 A1 Oct. 22, 2020

(30) Foreign Application Priority Data

Oct. 12, 2017 (IT) ..... 102017000115255

(51) Int. Cl.
*B05B 11/00* (2006.01)
*B65D 83/00* (2006.01)

(52) U.S. Cl.
CPC .... *B05B 11/00412* (2018.08); *B05B 11/0032* (2013.01); *B05B 11/3033* (2013.01);
(Continued)

(58) Field of Classification Search
CPC ..... B05B 11/00412; B05B 11/0032; B05B 11/3033; B05B 11/3067; B05B 11/3084;
(Continued)

(56) References Cited

U.S. PATENT DOCUMENTS 4,890,744 A * 1/1990 Lane, Jr. ..... B65D 75/5822 206/484
5,074,765 A * 12/1991 Pekar ..... F04B 45/04 417/480

(Continued)

FOREIGN PATENT DOCUMENTS

WO 2003008299 A1 1/2003

OTHER PUBLICATIONS

Patent Cooperation Treaty (PCT), International Search Report and Written Opinion for Application PCT/IB2018/05768 filed on Oct. 3, 2018, dated Nov. 27, 2018. ISA/EP.

*Primary Examiner* — Frederick C Nicolas
(74) *Attorney, Agent, or Firm* — McDonald Hopkins LLC

(57) ABSTRACT

The present invention concerns a system (1; 101; 201; 301; 401; 501; 601; 701; 801; 901; 1001; 1101; 1201) for dispensing a fluid (L; L1, L2), comprising a container (C; C') for the fluid (L; L1, L2) and a device (10; 410; 510) for dispensing the fluid (L; L1, L2). The device (10; 410; 510) comprises a collapsible chamber (20; 420) which defines a volume (V; V') suited to receive a quantity of the fluid (L; L1, L2) to be dispensed. The chamber (20; 420) is defined by a first portion (30; 430) and by a second portion (40) mutually coupled with each other, wherein the first portion (30; 430) comprises an area connected to the container (C; C') and the second portion (40) is constituted by a portion of the container (C; C').

11 Claims, 19 Drawing Sheets

(52) U.S. Cl.
CPC ..... *B05B 11/3067* (2013.01); *B05B 11/3084* (2013.01); *B05B 11/3087* (2013.01); *B65D 83/0055* (2013.01); *B65D 2221/00* (2013.01)

(58) Field of Classification Search
CPC ..... B05B 11/3087; B65D 2221/00; B65D 83/0055
See application file for complete search history.

(56) References Cited

U.S. PATENT DOCUMENTS

| | | | | |
|---|---|---|---|---|
| 5,207,355 | A | 5/1993 | Thomsen | |
| 6,789,706 | B2 * | 9/2004 | Abergel | B05B 11/3032 222/207 |
| 7,419,322 | B2 * | 9/2008 | Laflamme | A47K 5/1208 401/188 R |
| 8,919,613 | B2 * | 12/2014 | Mileti | G01F 11/08 222/207 |
| 2008/0237262 | A1 | 10/2008 | Laflamme et al. | |
| 2009/0263176 | A1 * | 10/2009 | Mileti | B05B 11/3032 401/184 |
| 2010/0096413 | A1 | 4/2010 | Genosar | |
| 2011/0253738 | A1 | 10/2011 | Mileti | |
| 2014/0252033 | A1 * | 9/2014 | Murray | B05B 11/3033 222/107 |
| 2016/0073833 | A1 | 3/2016 | Ciavarella et al. | |

* cited by examiner

SYSTEM FOR DISPENSING FLUIDS OR MIXTURES AND DEVICE USED IN SAID SYSTEM

CROSS-REFERENCE TO RELATED APPLICATION

This application is a 35 U.S.C. 371 national stage filing of PCT Application No. PCT/IB2018/057687 filed Oct. 3, 2018, entitled "SYSTEM FOR DISPENSING FLUIDS OR MIXTURES AND DEVICE USED IN SAID SYSTEM," which claims priority to Italian Patent Application No. 102017000115255 filed on Oct. 12, 2017, each of which are incorporated herein in their entirety by reference.

TECHNICAL FIELD OF THE INVENTION

The present invention concerns the technical field of systems for dispensing fluids or mixtures.

More specifically, the present invention concerns a system for dispensing at least one fluid from a container holding the fluid itself, especially suited to dispense food substances, perfumes, creams or detergents in general.

DESCRIPTION OF THE STATE OF THE ART

It is known that dispensing devices are used in the field of systems for dispensing liquid or creamy products, such as food substances, soaps, creams, detergents or perfumes, wherein said dispensing devices are provided with a collapsible chamber and are applied to the container holding said products.

Said devices are substantially constituted by a supporting structure provided with means for coupling the device with the neck of the container, and with a dispensing unit for the fluid held in the container, constituted by a collapsible chamber suited to suck and contain a dose of the fluid taken from the container and to dispense said dose.

The fluid is sucked into the collapsible chamber and dispensed through manual operation by the user, who first directly compresses and then releases the collapsible chamber by acting thereon with one or more fingers. During the compression step, the fluid contained inside the collapsible chamber is dispensed towards the external environment through a suitable outlet duct. During the successive release step, the collapsible chamber automatically returns to the position in which it is not compressed, sucking a dose of fluid from an inlet duct which is preferably provided with a thin tube that draws the fluid from the inside of the container. The dose of fluid drawn into the chamber itself is thus ready for the successive dispensing operation.

For this purpose, the dispensing device is provided with first valve means that allow or prevent the flow of the fluid from the inside of the container towards the chamber, said valve means being typically constituted by a ball that opens/closes the terminal portion of the thin tube introduced in the chamber.

The dispensing device is also provided with second valve means that allow or prevent the flow of the fluid from the inside of the chamber towards the outlet duct, also said valve means being typically constituted by a ball that opens/closes the outlet duct.

The containers used in said dispensing systems are sometimes constituted by collapsible/deformable containers, commonly known as pouches, sachets, packets or bag-in-boxes.

These systems comprising said types of container are generally of the disposable type.

The dispensing devices belonging to the state of the art, however, pose some drawbacks.

A first drawback posed by said dispensing devices is constituted by their construction complexity.

Another drawback posed by said devices is constituted by their considerable production costs and/or times.

A further drawback posed by said devices is represented by their complexity and by the reduced reliability of the area where the dispensing device is connected to the container.

The object of the present invention is to overcome said drawbacks.

More specifically, it is an object of the present invention to provide a solution that makes it possible to simplify the construction of the dispensing system.

It is another object of the present invention to provide a solution that makes it possible to reduce the production times and/or costs of said dispensing systems.

It is another object of the present invention to provide a dispensing system which is more reliable and more efficient than the devices of the known type.

SUMMARY OF THE PRESENT INVENTION

The present invention is based on the general consideration that it is desirable to provide a system for dispensing a fluid from a container, wherein said system is provided with a dispensing device comprising a collapsible chamber that defines a volume suited to receive a quantity of said fluid to be dispensed, and wherein said chamber is at least partially defined by a first portion and a second portion mutually coupled with each other in such a way that together they define said volume, and wherein said first portion comprises an area connected to said container and said second portion is constituted by a portion of said container.

According to a first aspect of the present invention, the subject of the same is a system for dispensing a fluid, comprising a container for said fluid and a device for dispensing said fluid, said device comprising:

- a collapsible chamber which defines a volume suited to receive a quantity of said fluid to be dispensed;
- an inlet duct suited to allow the passage of said fluid from the inside of said container towards said volume;
- first valve means suited to control the passage of said fluid into said inlet duct;
- an outlet duct for said fluid, suited to allow the passage of said fluid from said volume towards the outside;
- second valve means suited to control the passage of said fluid into said outlet duct, wherein said chamber is at least partially defined by a first portion and a second portion mutually coupled with each other in such a way that together they define said volume and define said inlet duct and said outlet duct, wherein said first portion comprises an area connected to said container and wherein said second portion is constituted by a portion of said container.

Preferably, the portion of said container comprises a flexible film.

The collapsible chamber is preferably defined by at least one elastically yielding area of the first portion.

According to a preferred embodiment, the first portion comprises an elastically yielding centre area and an annular peripheral area from which said centre area extends.

According to a preferred embodiment, the area of said first portion connected to said container corresponds to said annular peripheral area.

Preferably, the first portion and said container portion are mutually coupled with each other through a heat sealing operation.

In a preferred embodiment, the first portion is coupled with said container through a heat sealing operation.

According to a further preferred embodiment, the container comprises a first portion connected to said first portion of said device and a second portion that defines said second portion of said device.

Preferably, the first portion of said container comprises a flexible film and said second portion of said container comprises a flexible film.

In a preferred embodiment, the first portion of the container completely envelops said first portion of said device.

In a preferred embodiment, the inlet duct and/or the outlet duct is defined between said first portion and said second portion.

Preferably, the inlet duct and the outlet duct are aligned along the same direction.

According to a preferred embodiment, the container is shaped in such a way that it can receive a second fluid and the device comprises:

- a second collapsible chamber which defines a second volume suited to receive a quantity of said second fluid to be dispensed;
- a second inlet duct for the passage of said second fluid from the inside of said container towards said second volume;
- first valve means suited to control the passage of said second fluid in said second inlet duct;
- a second outlet duct for said second fluid, suited to allow the passage of said second fluid from said second volume towards the outside;
- second valve means suited to control the passage of said second fluid in said second outlet duct, wherein said second collapsible chamber is at least partially defined by a third portion and by said second portion mutually coupled with each other so that together they define said second volume and said second inlet duct and said second outlet duct, wherein said third portion comprises an area connected to said container.

According to a second aspect of the present invention, the subject of the same is a component for a device for dispensing a fluid, suited to be applied to a container holding said fluid, wherein said device comprises:

- a collapsible chamber which defines a volume suited to receive a quantity of said fluid to be dispensed;
- a inlet duct suited to allow the passage of said fluid from the inside of said container towards said volume;
- first valve means suited to control the passage of said fluid into said inlet duct;
- an outlet duct for said fluid, suited to allow the passage of said fluid from said volume towards the outside;
- second valve means suited to control the passage of said fluid into said outlet duct, wherein said collapsible chamber is at least partially defined by said component, said component comprising:

- a first area suited to be connected to said container;
- a second area suited to be coupled to a portion of said container, wherein said component and said portion of said container, when connected to each other, mutually define said volume, said inlet duct and said outlet duct.

The collapsible chamber is preferably defined by at least one elastically yielding area of said component.

According to a preferred embodiment, the component comprises an elastically yielding centre area and an annular peripheral area from which said centre area extends.

Preferably, the second area suited to be connected to said portion of said container corresponds to said annular peripheral area.

BRIEF DESCRIPTION OF THE DRAWINGS

Further advantages, objects and characteristics, as well as further embodiments of the present invention, are defined in the claims and will be illustrated in the following description with reference to the enclosed drawings; in the drawings, corresponding or equivalent characteristics and/or components of the present invention are identified by the same reference numbers. More specifically, in the drawings:

DETAILED DESCRIPTION OF PREFERRED EMBODIMENTS OF THE PRESENT INVENTION

Figure 1:
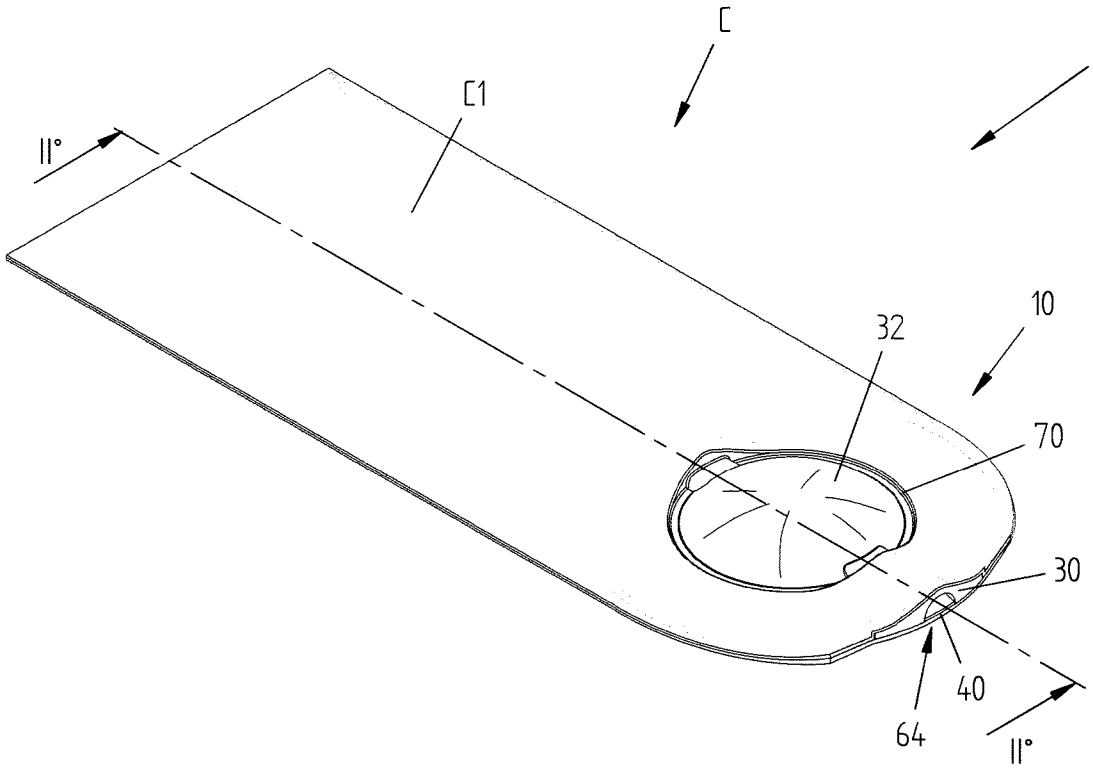
FIG. 1 shows an axonometric view of the dispensing system according to a preferred embodiment of the invention.

Although the present invention is described below with reference to its preferred embodiments illustrated in the drawings, the present invention is not limited to the embodiments described below and illustrated in the drawings. On the contrary, the embodiments described and illustrated herein clarify some aspects of the present invention, the scope of which is defined in the claims.

The examples of embodiment of the invention described here below concern a dispensing system for dispensing a product preferably constituted by a detergent or a toothpaste. It is clear that the dispensing system of the invention can be used also for dispensing perfumes or food products, or any other fluid in general, drawn from a container and conveyed towards the outside.

An example of a dispensing system 1 provided with a dispensing device 10 suited to dispense fluids according to a preferred embodiment of the invention is shown in FIG. 1. The dispensing system 1 preferably comprises said dispensing device 10 and a container C containing the fluid L to be dispensed.

Figure 3:
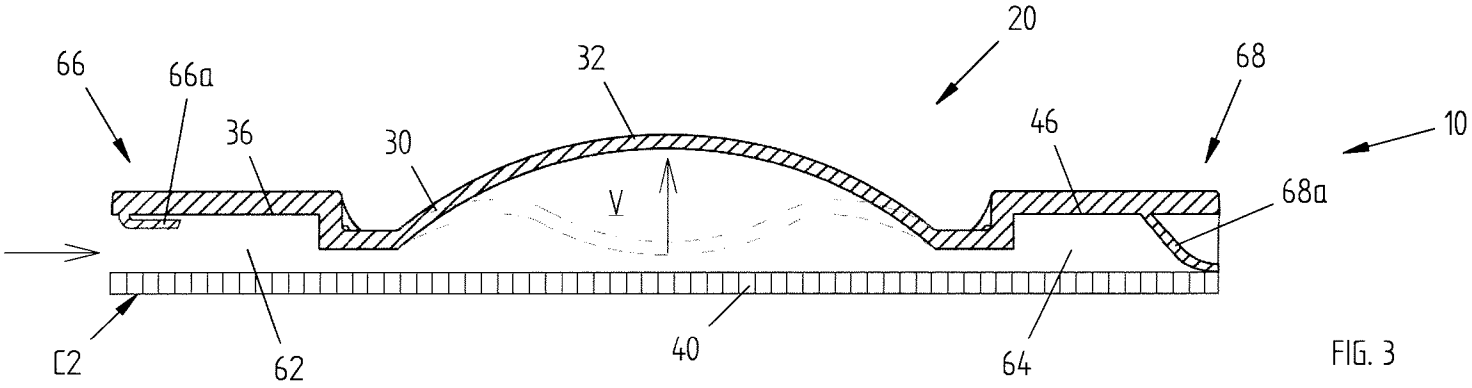
FIG. 3 shows a part of the dispensing system of FIG. 2 during the passage from a dispensing configuration to a rest configuration.
Figure 4:
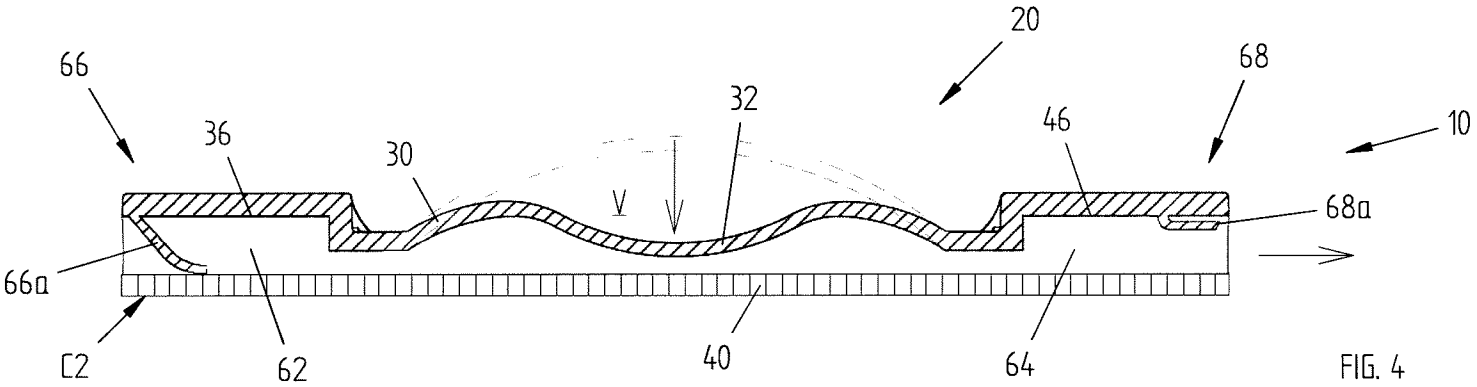
FIG. 4 shows the part shown in FIG. 3 during the passage from a rest configuration to a dispensing configuration.

FIGS. 3 and 4 show a detail of the dispensing device 10.

The dispensing device 10 defines the part of the dispensing system 1 which is suited to be operated by the user in order to dispense a dose of fluid L drawn from the container C.

For the sake of clarity, the fluid or the fluids are not shown in the figures to which the description makes reference.

The dispensing device 10 preferably comprises a collapsible chamber 20 which defines a volume V suited to receive a quantity of fluid L to be dispensed.

The collapsible chamber 20, as described in greater detail below, is preferably defined by an elastically yielding portion suited to be operated/squeezed by the user.

The dispensing device 10 preferably comprises an inlet duct 62 for the passage of the fluid L from the inside of the container C towards the volume V and an outlet duct 64 for the passage of the fluid L from the volume V towards the outside.

First valve means 66 are associated with the inlet duct 62 in order to control the passage of the fluid L from the container C towards said volume V.

Second valve means 68 are associated with the outlet duct 64 in order to control the passage of the fluid L from said volume V towards the outside.

The volume V defined by the collapsible chamber 20 is suited to contain a dose of the fluid L which is drawn from the container C and successively dispensed towards the outside.

The fluid L is sucked into the volume V defined by the collapsible chamber 20 and dispensed through manual operation by the user, who first directly compresses and then releases the collapsible chamber 20 by acting thereon with one or more fingers, as shown in FIGS. 3 and 4. During the compression step shown in FIG. 4, the fluid L contained in the volume V is dispensed towards the outside through the outlet duct 64. During this step, the second valve means 68 are open in order to allow the fluid L to flow towards the outlet, while the first valve means 66 are closed in order to prevent the flow of the fluid L from the volume V towards the inside of the container C.

During the successive release step shown in FIG. 3, the collapsible chamber 20 automatically returns to the position in which it is not compressed, drawing a dose of the fluid L from the inside of the container C through the inlet duct 62.

During this step, the first valve means 66 are open in order to allow the fluid L to flow from the inside of the container C towards the volume V, while the second valve means 68 are closed in order to close the outlet duct 64.

The dose of the fluid L sucked into the volume V is thus ready for the successive dispensing operation.

According to a first advantageous aspect of the present invention, the collapsible chamber 20 is defined by a first portion 30 and by a second portion 40 which are coupled with each other in such a way that together they define said volume V.

According to another advantageous aspect of the present invention, the first portion 20 comprises an area which is directly connected to said container C and the second portion 40 is constituted by a portion 40 of the container C.

At least one area 32 of the first portion 30 is elastically yielding, in such a way that it defines said collapsible chamber 20 and can be deformed when the user squeezes it. Preferably, this is achieved by selecting a suitable material and/or a suitable thickness of the first portion 30 and of the respective elastically yielding area 32.

The elastically yielding area 32 preferably has a hemispherical shape.

The first portion 30 of the device 10 is preferably made of a plastic material, preferably through an injection moulding process.

Figure 5:
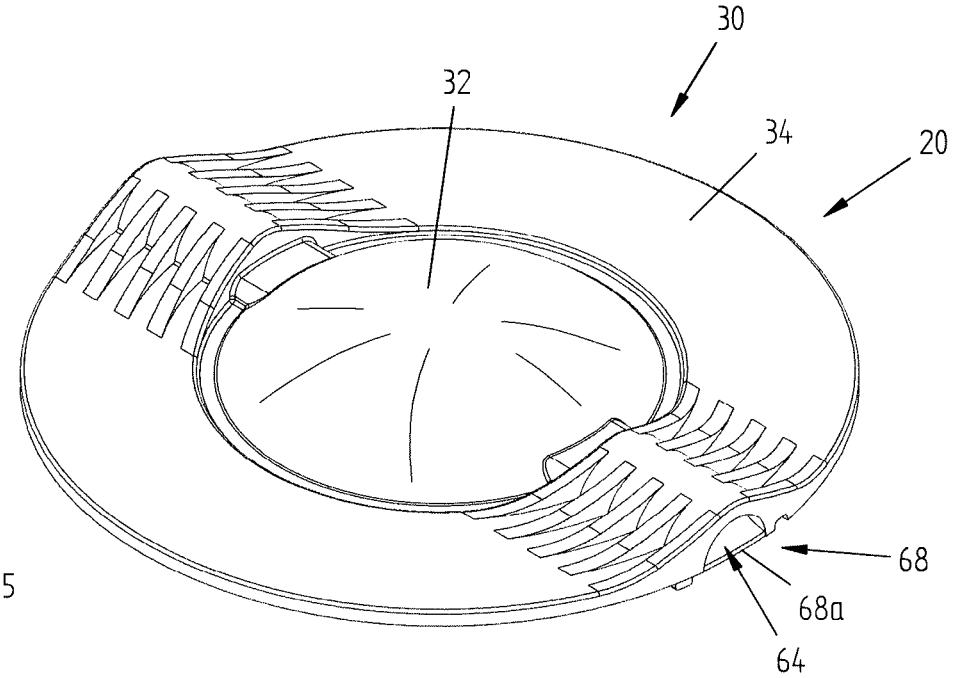
FIG. 5 shows an axonometric view of a component of the dispensing system shown in FIG. 1 isolated from the rest.
Figure 6:
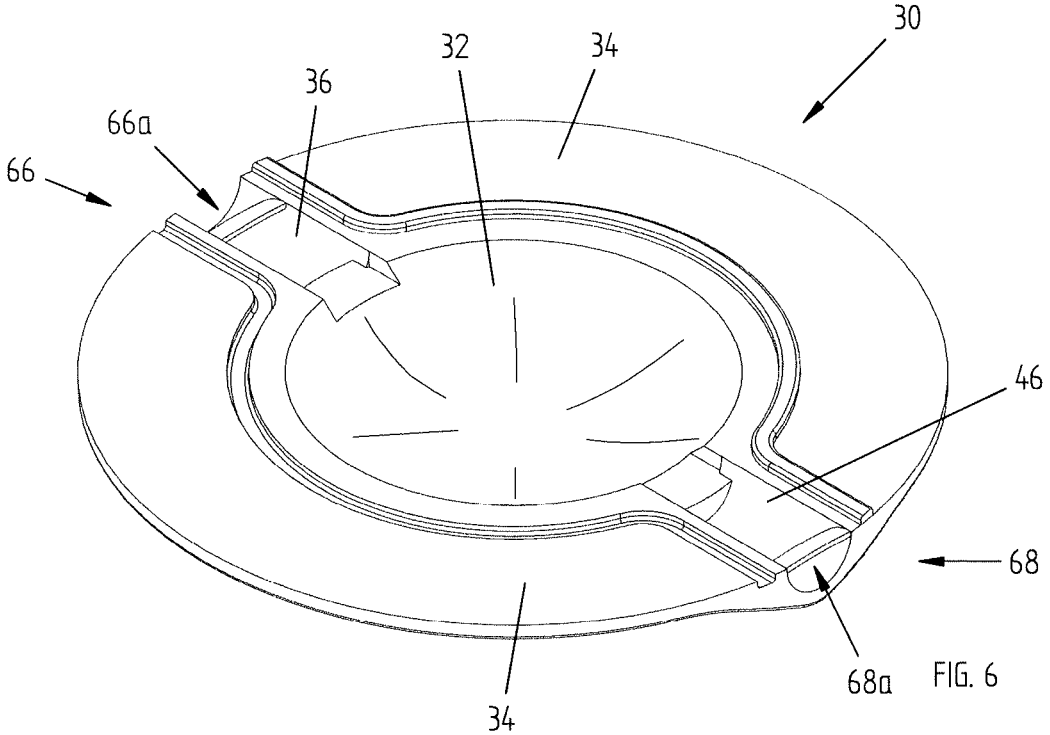
FIG. 6 shows an axonometric view of the component shown in FIG. 5 from another point of view.

The first portion 30 is illustrated in greater detail in FIGS. 5 and 6.

The first portion 30 comprises said elastically yielding area 32 that extends preferably centrally towards an annular peripheral area 34 which is substantially flat.

The elastically yielding centre area 32 and the annular peripheral area 34 are preferably circular in shape.

In variant embodiments, however, said shape can be different.

The annular peripheral area 34 comprises, in a specific selected point, a first channel 36 that defines part of the inlet duct 62 of the device 10 when the first portion 30 is coupled with the second portion 40. The inlet duct 62 is therefore defined by the first channel 36 of the first portion 30 and delimited by the second portion 40.

The annular peripheral area 34 furthermore comprises, in a specific selected point, a second channel 46 that defines part of the outlet duct 64 of the device 10 when the first portion 30 is coupled with the second portion 40. The outlet duct 64 is therefore defined by the second channel 46 and delimited by the second portion 40.

Advantageously, therefore, when the first portion 30 and the second portion 40 are coupled with each other, they define said inlet duct 62 and said outlet duct 64.

Preferably, the inlet duct 62 and the outlet duct 64 are aligned along the same direction, that is, they preferably lie at 180° from each other.

The first channel 36 preferably comprises the first valve means 66, constituted by a tab 66*a* suited to obstruct/open the first channel 36, which is shown in greater detail in FIG. 6.

Analogously, the second channel 46 preferably comprises the second valve means 68 constituted by a tab 68*a* suited to obstruct/open the second channel 46, which is shown in greater detail in FIG. 6.

Figure 7:
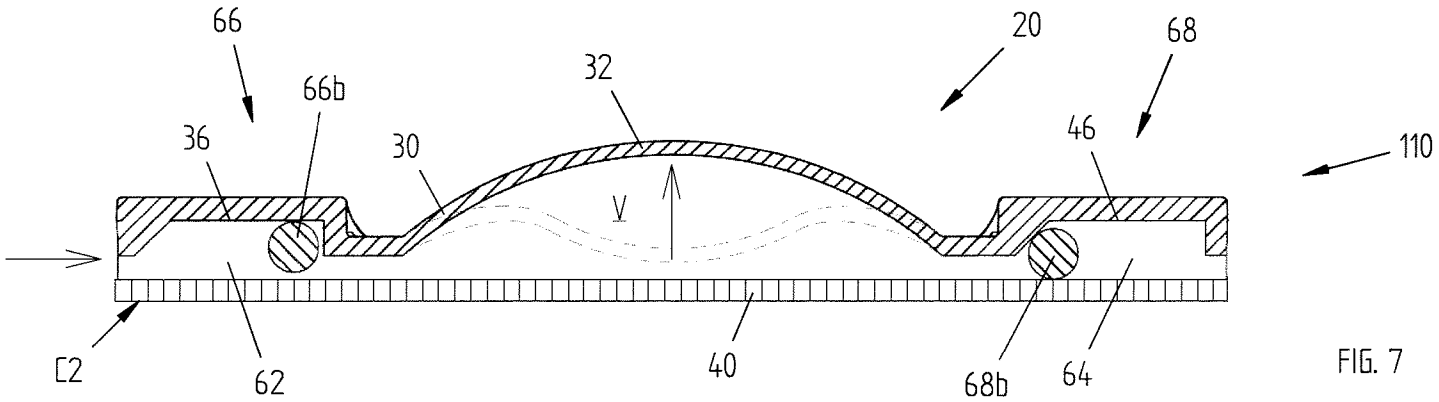
FIG. 7 shows a first variant embodiment of the part shown in FIG. 3 during the passage from a dispensing configuration to a rest configuration.
Figure 8:
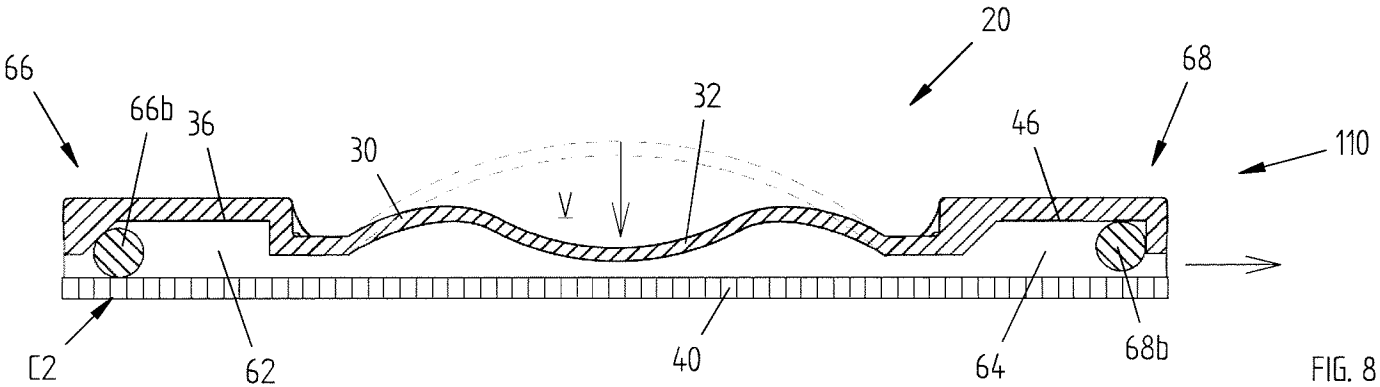
FIG. 8 shows the part shown in FIG. 7 during the passage from a rest configuration to a dispensing configuration.

In variant embodiments, the first and/or the second valve means can be of different types, as shown for example in FIGS. 7 and 8, where the function of opening/closing the respective channels is served by balls instead of by tabs.

The mutual coupling of the first and the second portion 30, 40 is preferably obtained by heat sealing. In variant embodiments, however, different connection means can be used, such as, for example, an adhesive substance.

A further advantageous aspect of the present invention is related to the mutual connection between the first portion 30 and the container C.

More specifically, the first portion 30 of the device 10 comprises an area which is directly connected to the container C.

Figure 2:
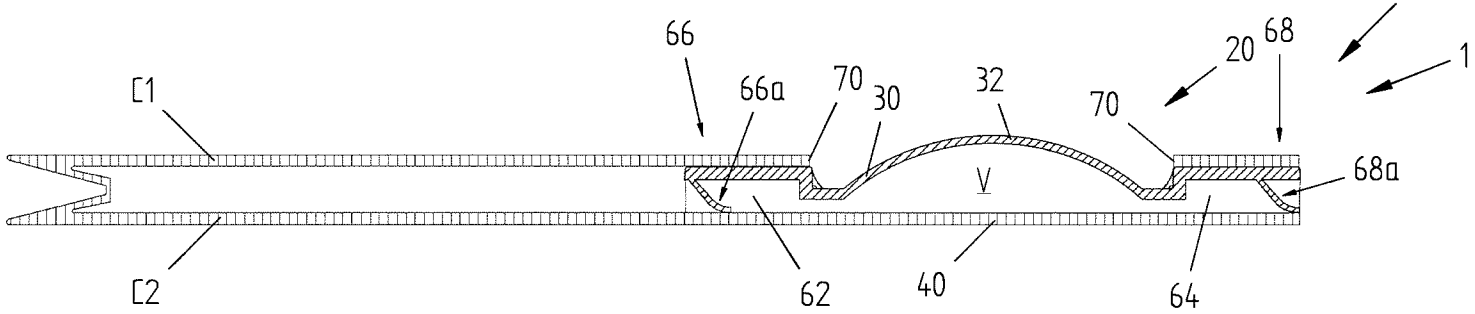
FIG. 2 shows the sectional view of FIG. 1 according to line II-II.

In the preferred embodiment illustrated herein, more specifically as shown in FIGS. 1 and 2, the container C is preferably made of a collapsible/deformable material. This type of container is commonly known as pouche, sachet, packet or bag-in-box.

Preferably, the container C comprises a first portion C1, also identified as upper portion in the various figures, and a second portion C2, also identified as lower portion in the various figures, which are mutually coupled in order to define a convenient volume for containing the fluid L.

Preferably, the upper portion C1 of the container C peripherally envelops the first portion 30 of the collapsible chamber 20 and is provided with a hole 70 suited to allow the elastically yielding centre area 32 of the first portion 30 to project therefrom.

Preferably, the portions C1, C2 of the container C comprise a respective plastic film. The portions C1, C2 can be preferably made of composite materials or of materials such as PET, PE, PP, EVOH, NYLON, aluminium, etc.

According to an advantageous aspect of the present invention, the coupling of the upper portion C1 and lower portion C2 of the container C with the corresponding first portion 30 is preferably obtained through a heat sealing process.

According to a preferred embodiment, the coupling of the first portion 30, the upper portion C1 and the lower portion C2 of the container C is advantageously carried out in a single step, by superimposing them and joining them to one another.

According to a preferred embodiment, the joining process includes a heat sealing step, preferably at the level of the annular peripheral area 34 of the first portion 30 of the device 10. In variant embodiments, connection means of a different type can be used, for example an adhesive substance.

Advantageously, the construction of the dispensing device 10 and of the dispensing system 1 according to the invention is simplified compared to the systems known in the art.

Advantageously, the respective production times and/or costs of said dispensing systems are reduced compared to the systems known in the art.

The simplified implementation of the dispensing system leads to increased reliability and efficiency compared to the systems of the known type.

Furthermore, the connection of the type described above between the dispensing device 10 and the container C is more reliable than in the systems of the known type, in which the container typically needs a portion made ad hoc, for example a more or less rigid neck, for connection to the dispensing device.

FIGS. 7 and 8 show a variant embodiment 110 of the dispensing device of the invention, as already mentioned above, which differs from the previous embodiment due to the shape of the first and second valve means 66, 68, which in this case preferably comprise two balls 66*b*, 68*b* instead of two tabs, intended to serve the function of opening/closing the respective inlet channel 62 and outlet channel 64.

Figure 9:
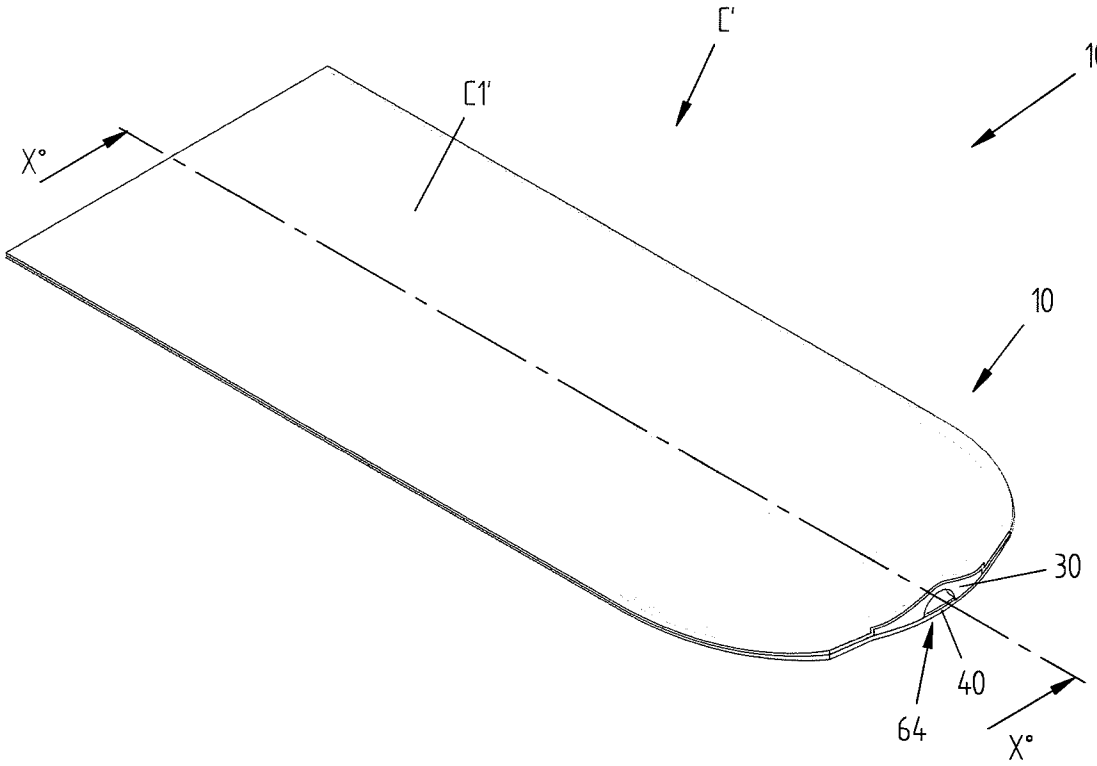
FIG. 9 shows an axonometric view of the dispensing system shown in FIG. 1 according to another embodiment of the invention.
Figure 10:
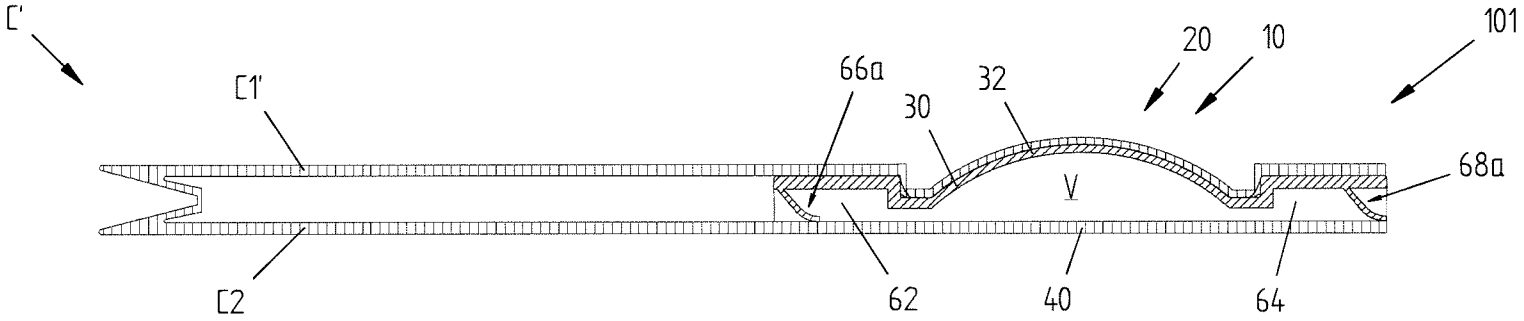
FIG. 10 shows the sectional view of FIG. 9 according to line X-X.

FIGS. 9 and 10 show a variant embodiment 101 of the dispensing system of the invention, which differs from the embodiment described with reference to FIGS. from 1 to 6 in that the upper portion C1' of the container C' completely envelops the first portion 30 of the dispensing device 10, that is, the part without the hole 70, and thus covers the elastically yielding centre area 32 of the first portion 30.

Figure 11:
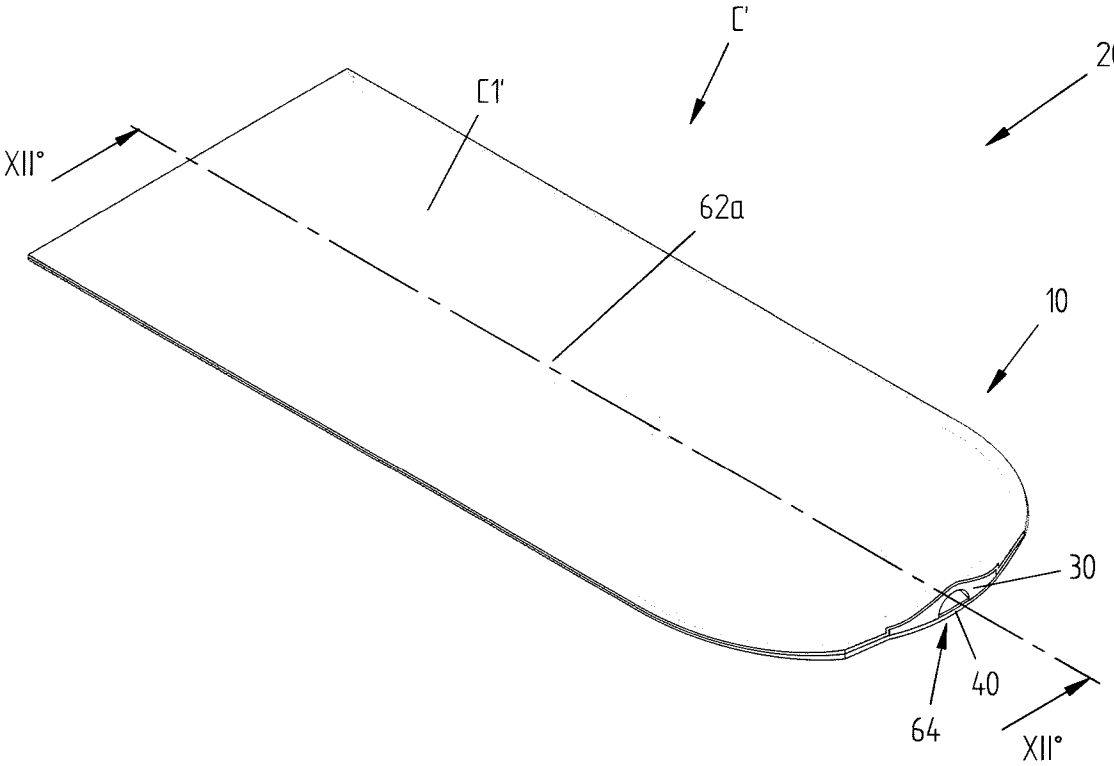
FIG. 11 shows an axonometric view of the dispensing system of FIG. 9 according to another embodiment of the invention.
Figure 12:
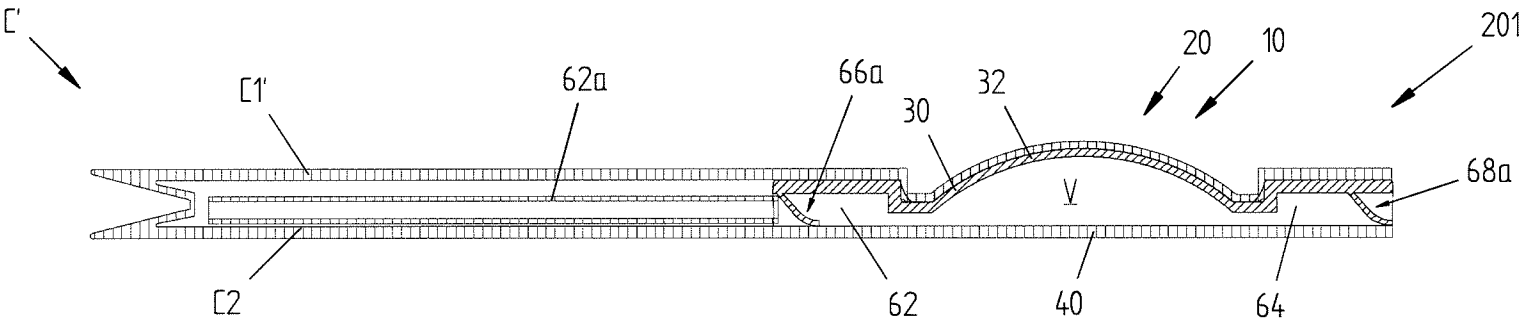
FIG. 12 shows the sectional view of FIG. 11 according to line XII-XII.

FIGS. 11 and 12 show a variant embodiment 201 of the dispensing system of the invention, which differs from the embodiment described with reference to FIGS. 11 and 12 in that the inlet duct 62 is preferably associated with a suction pipe 62*a* whose predetermined length is such that it substantially terminates in proximity to the bottom of the container C'. This makes it easier to draw the fluid from the bottom of the container C'.

Figure 13:
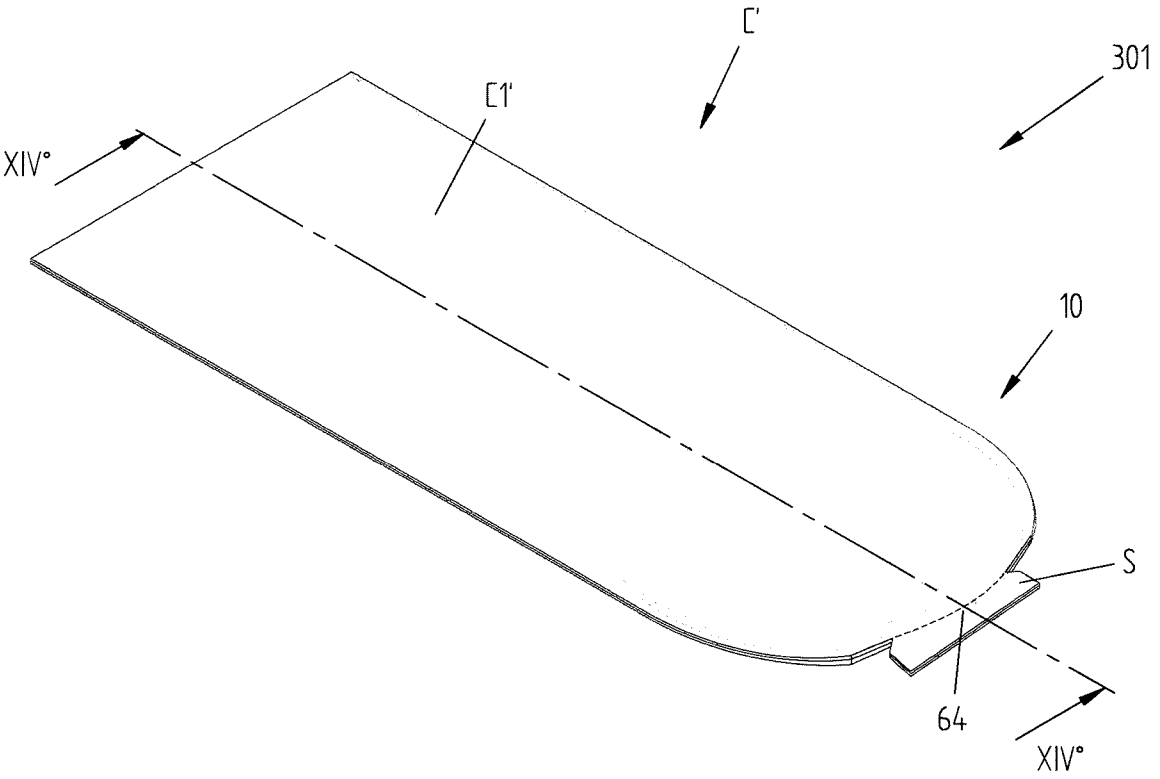
FIG. 13 shows an axonometric view of the dispensing system shown in FIG. 9 according to another embodiment of the invention.
Figure 14:
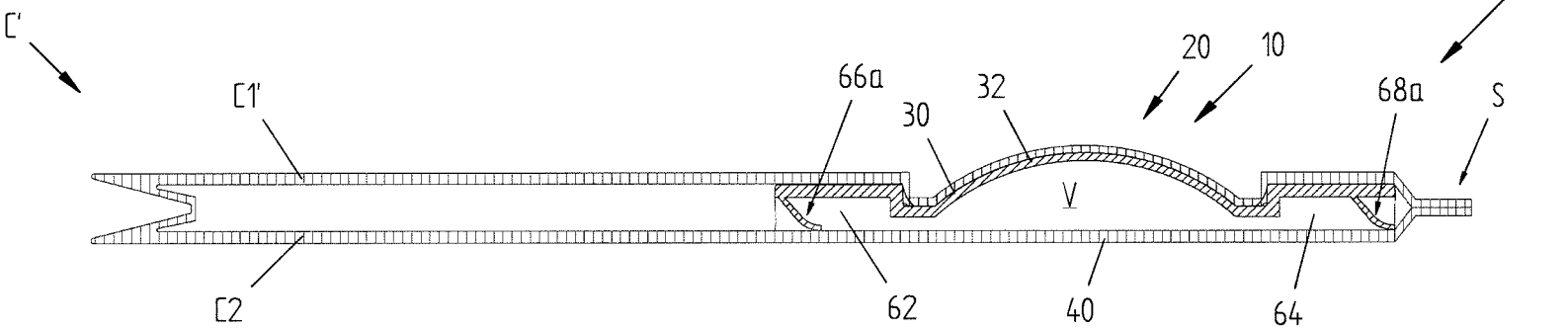
FIG. 14 shows the sectional view of FIG. 13 according to line XIV-XIV.

FIGS. 13 and 14 show a variant embodiment 301 of the dispensing device of the invention, which differs from the embodiment 101 of the dispensing system illustrated with reference to FIGS. 9 and 10 in that it comprises also a sealing element S associated with the container C1' and arranged at the level of the outlet duct 64 of the dispensing device.

The sealing element S constitutes a removable portion, preferably a tear-off portion, suited to be removed before the dispensing system 301 is used for the first time.

Figure 15:
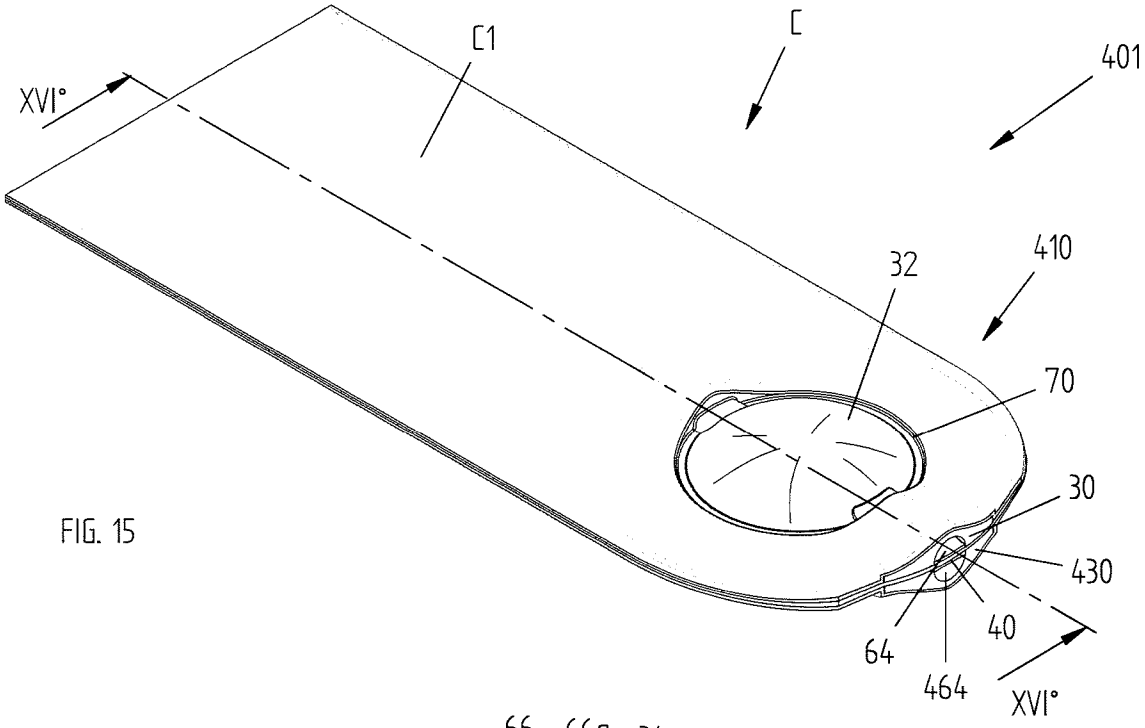
FIG. 15 shows an axonometric view of the dispensing system shown in FIG. 1 according to another embodiment of the invention.
Figure 16:
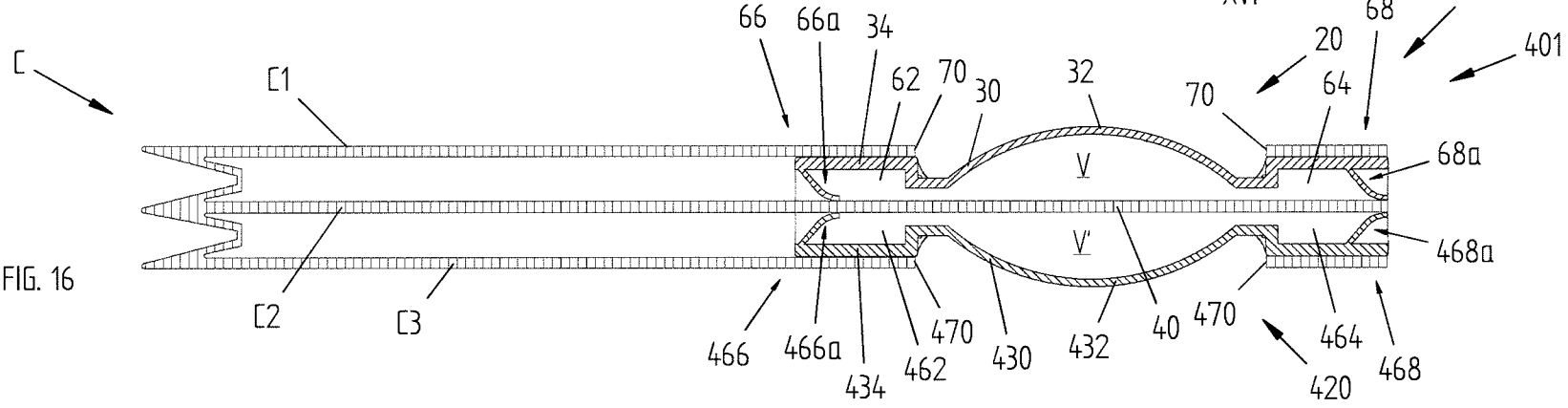
FIG. 16 shows the sectional view of FIG. 15 according to line XVI-XVI.

FIGS. 15 and 16 show a variant embodiment 401 of the dispensing system of the invention.

The dispensing system 401 according to said embodiment thus allows two doses of respective fluids L1, L2 to be drawn from the container C.

For this purpose, the dispensing system 401 comprises a dispensing device 410 suited to be operated by the user in order to simultaneously dispense two fluids L1, L2 conveniently held in the container C.

The comparison between FIGS. 15 and 16 and Figures from 1 to 6 shows that the dispensing system 401 according to said embodiment substantially corresponds to the duplication of the dispensing system 1 according to the previous embodiment.

The dispensing device 410 preferably comprises two collapsible chambers 20, 420 which define two volumes V, V', each suited to receive a quantity of a respective fluid L1, L2 to be dispensed.

The collapsible chambers 20, 420 are preferably defined by respective elastically yielding portions suited to be operated/squeezed by the user.

The dispensing device 410 preferably comprises two inlet ducts 62, 462 for the passage of respective fluids L1, L2 from the inside of the container C towards said volumes V, V' and two outlet ducts 64, 464 for the passage of the fluids L1, L2 from the respective volumes V, V' towards the outside.

First valve means 66, 466 are associated with the inlet ducts 62, 462 in order to control the passage of the fluids L1, L2 from the container C towards said volumes V, V'.

Second valve means 68, 468 are associated with the outlet ducts 64, 464 in order to control the passage of the fluids L1, L2 from said volumes V, V' towards the outside.

The two fluids L1, L2 are sucked and dispensed according to a procedure which is analogous to that described above with reference to one fluid only, through manual operation by the user, who first directly compresses the two collapsible chambers 20, 420 with one or more fingers and then releases them. During the compression step, the fluids L1, L2 contained in the volumes V, V' are dispensed towards the outside through the outlet ducts 64, 464. During this step, the second valve means 68, 468 are open in order to allow the fluids L1, L2 to flow towards the outlet, while the first valve means 66, 466 are closed in order to prevent the fluids L1, L2 from flowing from the volumes V, V' towards the inside of the container C.

During the successive release step, the collapsible chambers 20, 420 automatically return to the position in which they are not compressed, drawing doses of fluid L1, L2 from the inside of the container C through the inlet ducts 62, 462.

During this step, the first valve means 66, 466 are open in order to allow the fluids L1, L2 to flow from the inside of the container C towards the volumes V, V', while the second valve means 68, 468 are closed in order to block the outlet ducts 64, 464. The doses of fluid L1, L2 drawn into the volumes V, V' are thus ready for the successive dispensing operation.

It should be noted that said dispensing system 401 can be used, for example, for dispensing toothpastes in two colours/compositions, which inside the container C are separate and are combined outside the outlet ducts 64, 464 of the dispensing system 401 in order to be put on the toothbrush. In general, said dispensing system 401 can be advantageously used to dispense bi-component products which are mixed at the moment of use and cannot be mixed in advance.

According to an advantageous aspect of the invention, analogously to what has been explained with reference to the first embodiment, the first collapsible chamber 20 is defined by a first portion 30 and by a second portion 40 which are coupled to each other in such a way that together they define the first volume V and the second collapsible chamber 420 is defined by a third portion 430 and by said second portion 40 which are mutually coupled to each other in such a way that together they define the second volume V'.

According to another advantageous aspect of the present invention, the first and the third portion 30, 430 comprise an area directly connected to the container C and the second portion 40 is constituted by a common portion 40 of the container C.

Further characteristics of the system 401 can be simply inferred by duplicating the description provided with reference to the first embodiment. More specifically, the elements having the same characteristics are indicated by the same reference number increased by 400 (for example, the elastically yielding areas 32 and 432 or the first valve means 66 and 466 have the same characteristics).

The mutual coupling of the first, the second and the third portion 30, 40, 430 is preferably obtained through a heat sealing operation. In variant embodiments, however, different connection means can be used, such as, for example, an adhesive substance.

A further advantageous aspect of the present invention is related to the mutual connection existing among the first portion 40, the third portion 430 and the container C.

Preferably, the container C comprises a first portion C1, also identified as upper portion in the figures, a second portion C2, also identified as intermediate portion in the figures, and a third portion C3, also identified as lower portion in the figures. These portions Cl, C2 and C3 are mutually coupled with one another in such a way as to define two volumes suited to contain the fluids L1 and L2 inside the container C.

Preferably, the upper portion C1 of the container C peripherally envelops the first portion 30 of the first collapsible chamber 20 and is provided with a hole 70 in order to allow the elastically yielding centre area 32 of the first portion 30 to project therefrom.

Preferably, the lower portion C3 of the container C peripherally envelops the third portion 430 of the second collapsible chamber 420 and is provided with a hole 470 in order to allow the elastically yielding centre area 432 of the third portion 430 to project therefrom.

Preferably, the intermediate portion C2 divides the two volumes located inside the container so that they can contain the respective fluids and furthermore a portion 40 of it defines the second common portion 40 of the two collapsible chambers 20, 420. Preferably, the portions C1, C2, C3 of the container C comprise a respective plastic film.

The portions C1, C2, C3 can be preferably constituted by composite materials or by materials such as PET, PE, PP, EVOH, NYLON, aluminium, etc.

According to an advantageous aspect of the present invention, the coupling of the upper portion C1, the intermediate portion C2 and the lower portion C3 of the container C and of the first and third portions 30, 430 is preferably obtained through a heat sealing operation.

In a preferred embodiment, however, said coupling is advantageously carried out in a single step, by superimposing them and joining them to one another.

In a preferred embodiment, the joining operation includes a heat sealing step, preferably at the level of the annular peripheral areas 34, 434 of the first and third portions 30, 430 of the device 410. In variant embodiments connection means of a different type can be used, for example an adhesive substance.

Advantageously, the construction structure of the dispensing device 410 and of the dispensing system 401 according to the invention is simplified compared to the devices and systems known in the art.

Advantageously, the respective production times and/or costs of said dispensing systems are reduced compared to the systems known in the art.

The simplified implementation of the dispensing system leads to increased reliability and efficiency compared to the systems of the known type.

Furthermore, the connection of the type described above between the dispensing device 410 and the container C is more reliable than in the systems of the known type, in which the container typically needs a portion made ad hoc, for example a more or less rigid neck, for connection to the dispensing device.

Figure 17:
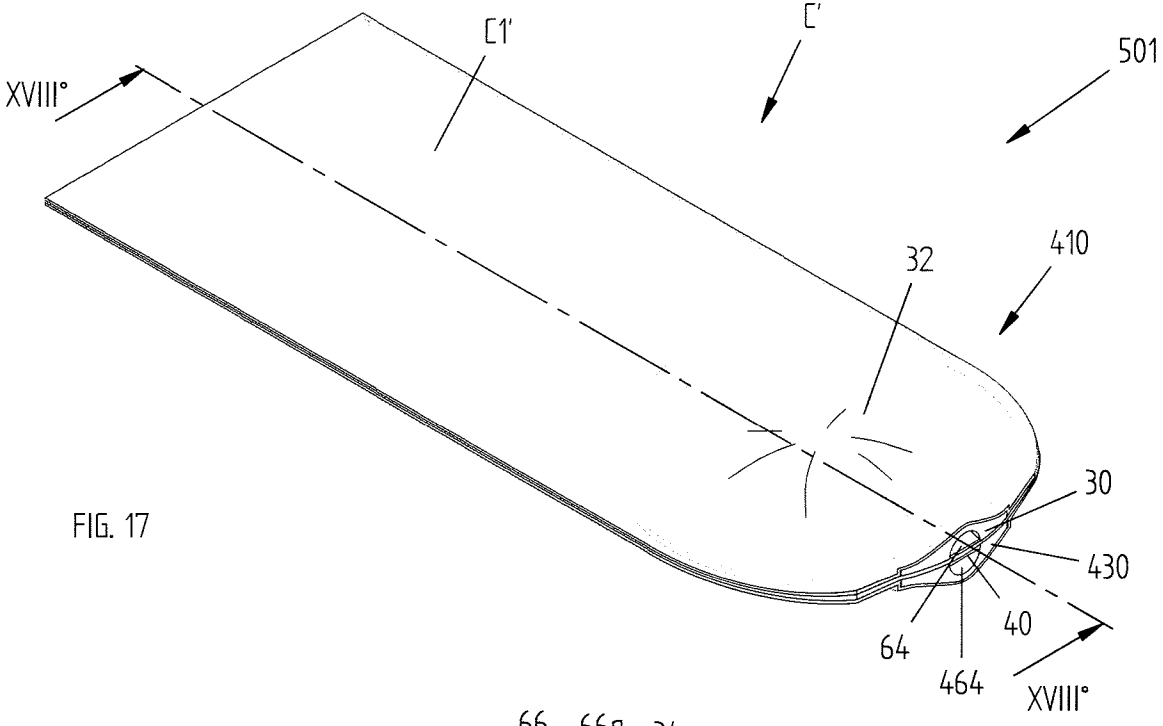
FIG. 17 shows an axonometric view of the dispensing system shown in FIG. 15 according to another embodiment of the invention.
Figure 18:
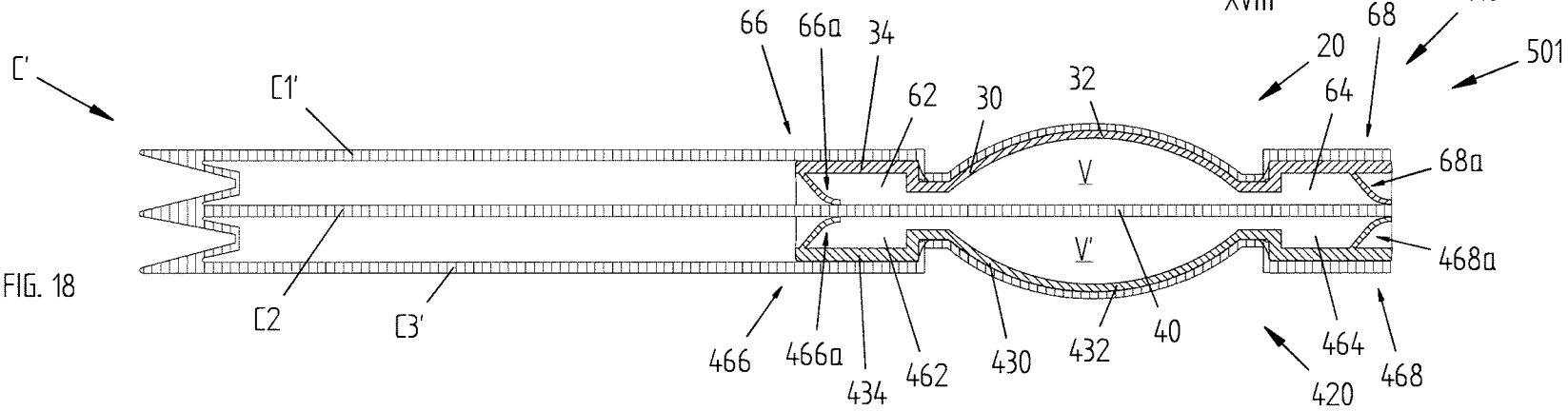
FIG. 18 shows the sectional view of FIG. 17 according to line XVIII-XVIII.

FIGS. 17 and 18 show a variant embodiment 501 of the dispensing system of the invention, which differs from the embodiment described with reference to FIGS. 15 and 16 in that:

- the upper portion C1' of the container C' completely envelops the first portion 30 of the first collapsible chamber 20, that is, the part without the hole 70, and thus covers the elastically yielding centre area 32 of the first portion 30;
- the lower portion C3' of the container C' completely envelops the third portion 430 of the second collapsible chamber 420, that is, the part without the hole 470, and thus covers the elastically yielding centre area 432 of the third portion 430.

Figure 19:
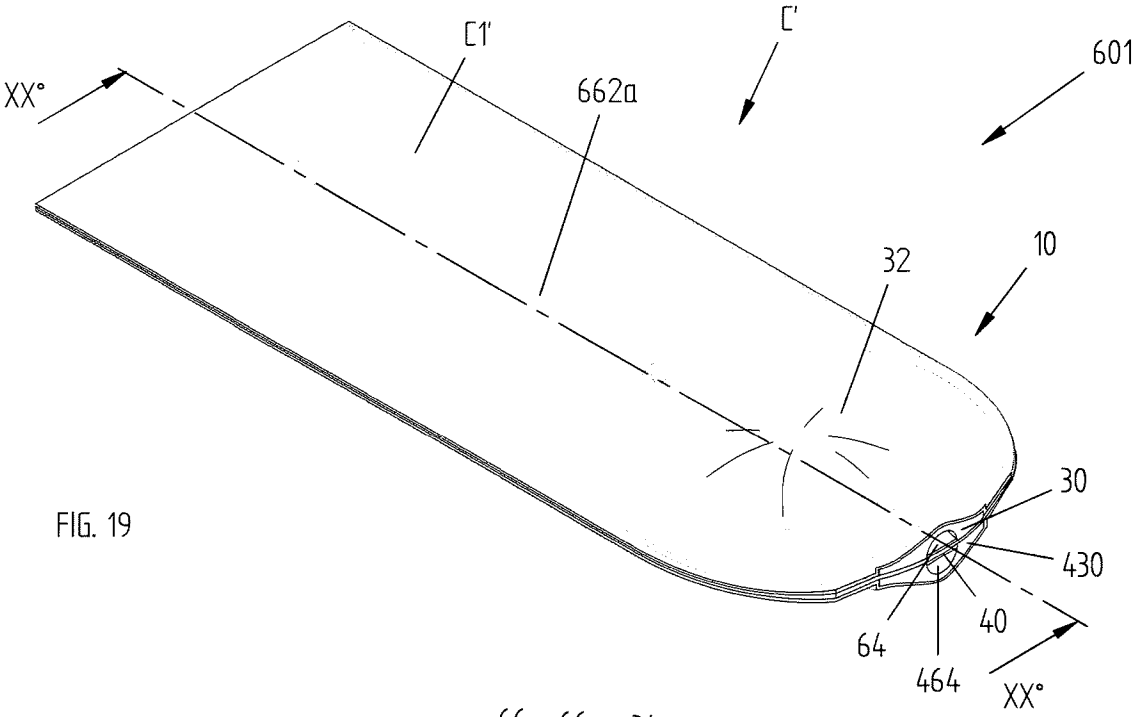
FIG. 19 shows an axonometric view of the dispensing system shown in FIG. 17 according to another embodiment of the invention.
Figure 20:
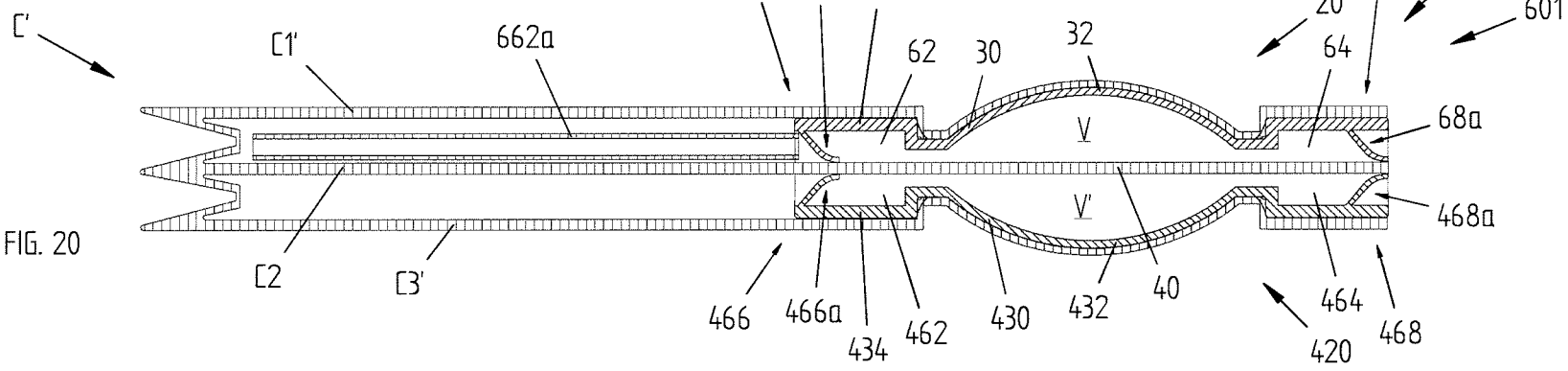
FIG. 20 shows the sectional view of FIG. 19 according to line XX-XX.

FIGS. 19 and 20 show a variant embodiment 601 of the dispensing system of the invention, which differs from the embodiment described with reference to FIGS. 17 and 18 in that the inlet duct 62 is preferably associated with a suction pipe 662*a* whose predetermined length is such that it substantially terminates in proximity to the bottom of the container C'. This makes it easier to draw the fluid L1 from the bottom of the container C'.

Figure 21:
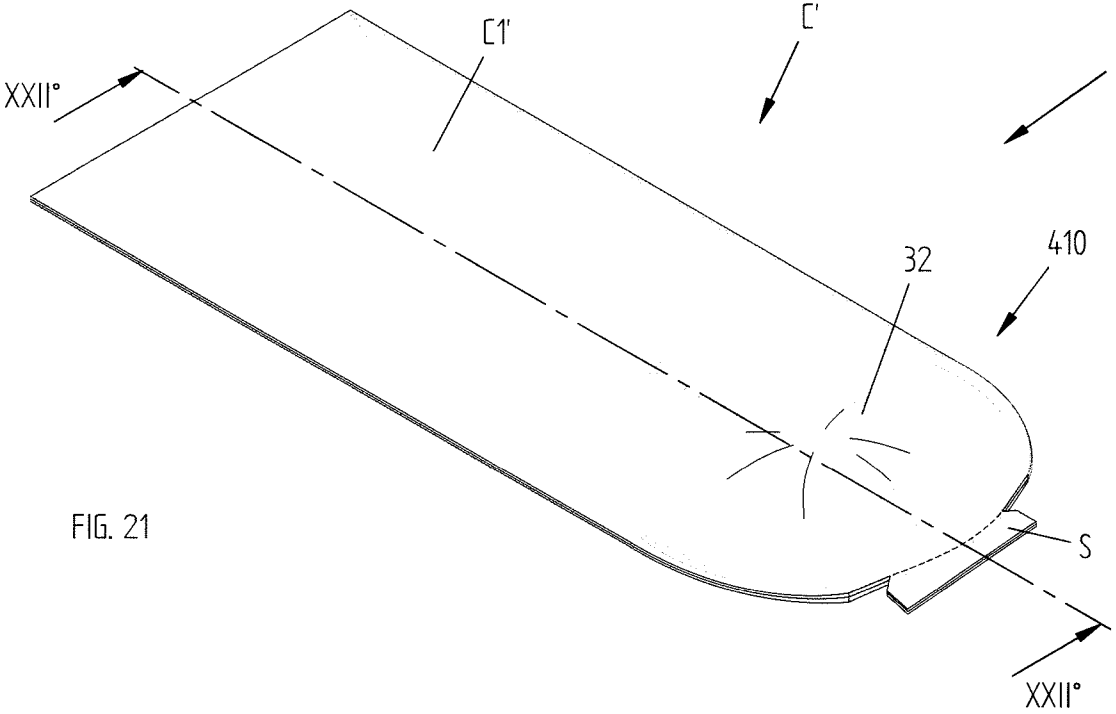
FIG. 21 shows an axonometric view of the dispensing system shown in FIG. 17 according to another embodiment of the invention.
Figure 22:
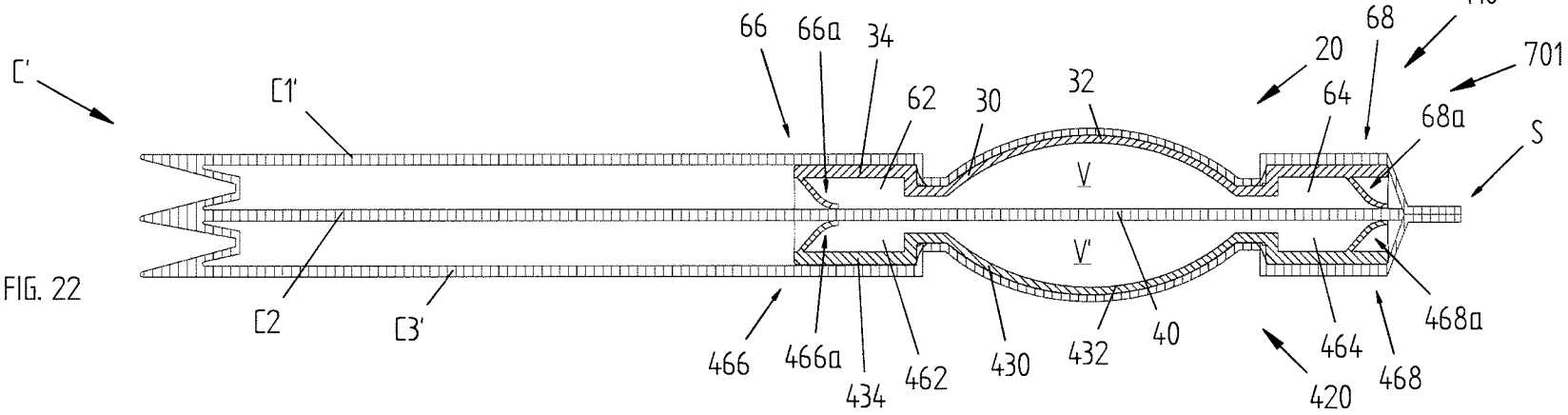
FIG. 22 shows the sectional view of FIG. 21 according to line XXI-XXI.

FIGS. 21 and 22 show a variant embodiment 701 of the dispensing system of the invention, which differs from the embodiment 501 of the dispensing system described with reference to FIGS. 17 and 18 in that it furthermore comprises a sealing element S associated with the container C' and arranged at the level of the outlet ducts 64, 464 of the dispensing device 410.

Figure 23:
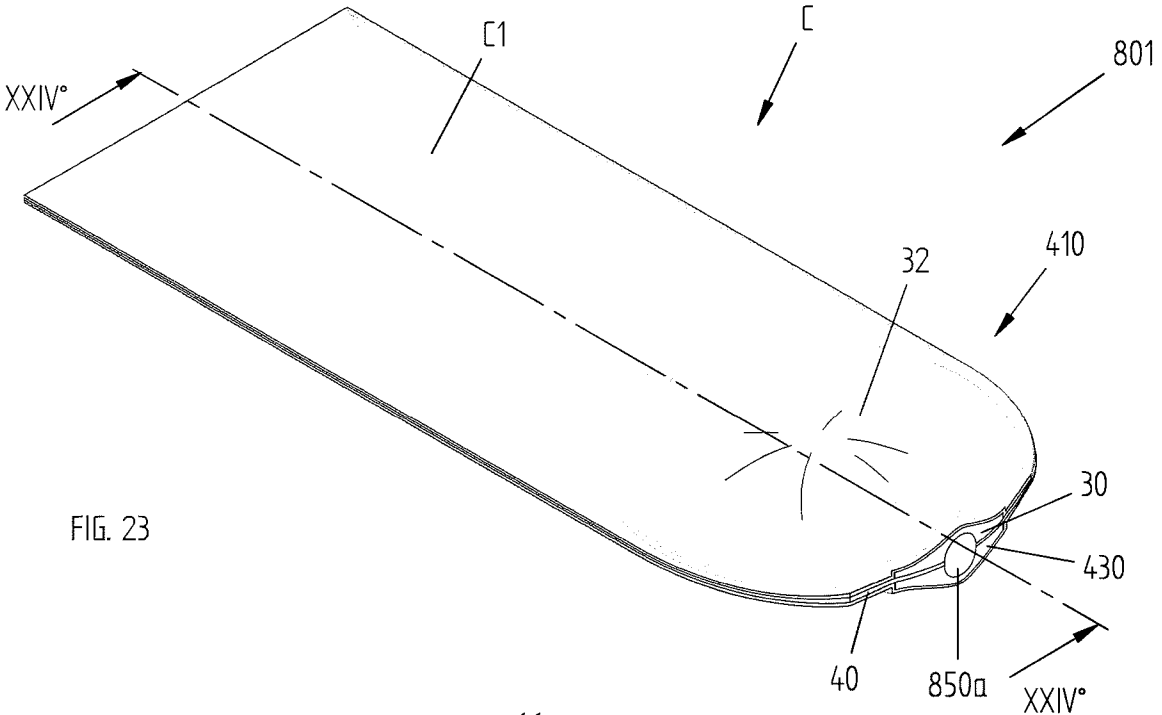
FIG. 23 shows an axonometric view of the dispensing system shown in FIG. 1 according to another embodiment of the invention.
Figure 24:
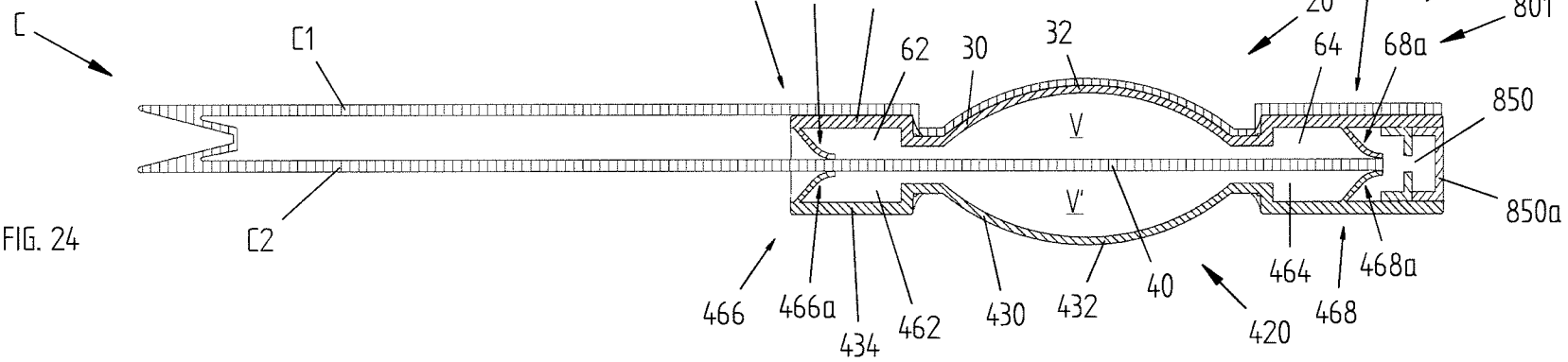
FIG. 24 shows the sectional view of FIG. 23 according to line XXIV-XXIV.
Figure 25:
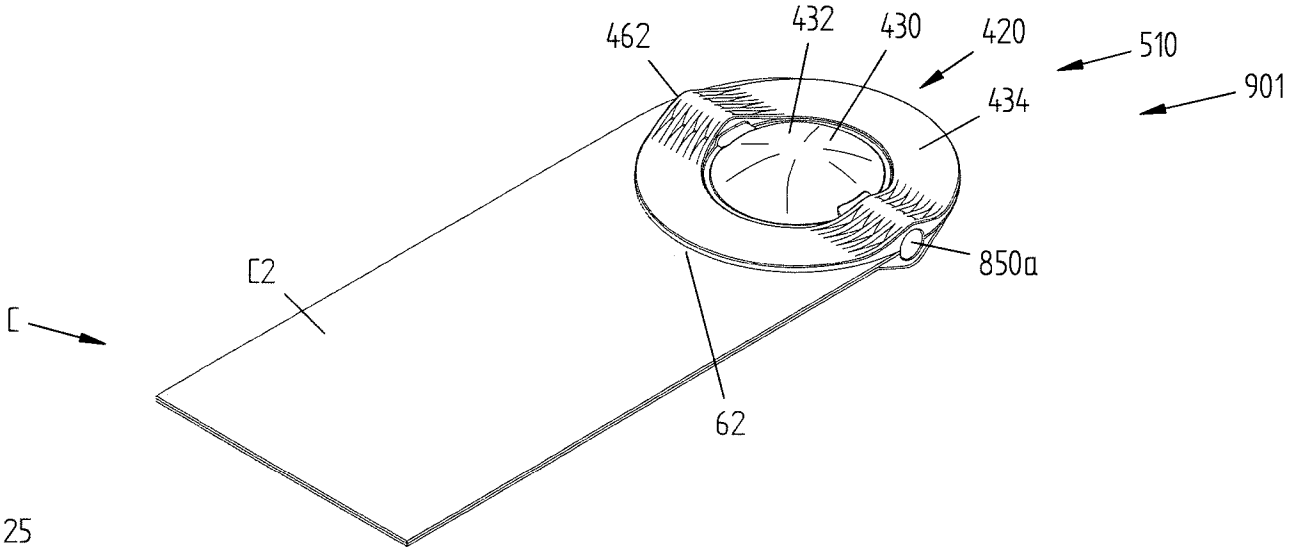
FIG. 25 shows an axonometric view of the dispensing system shown in FIG. 23 according to another embodiment of the invention.
Figure 26:
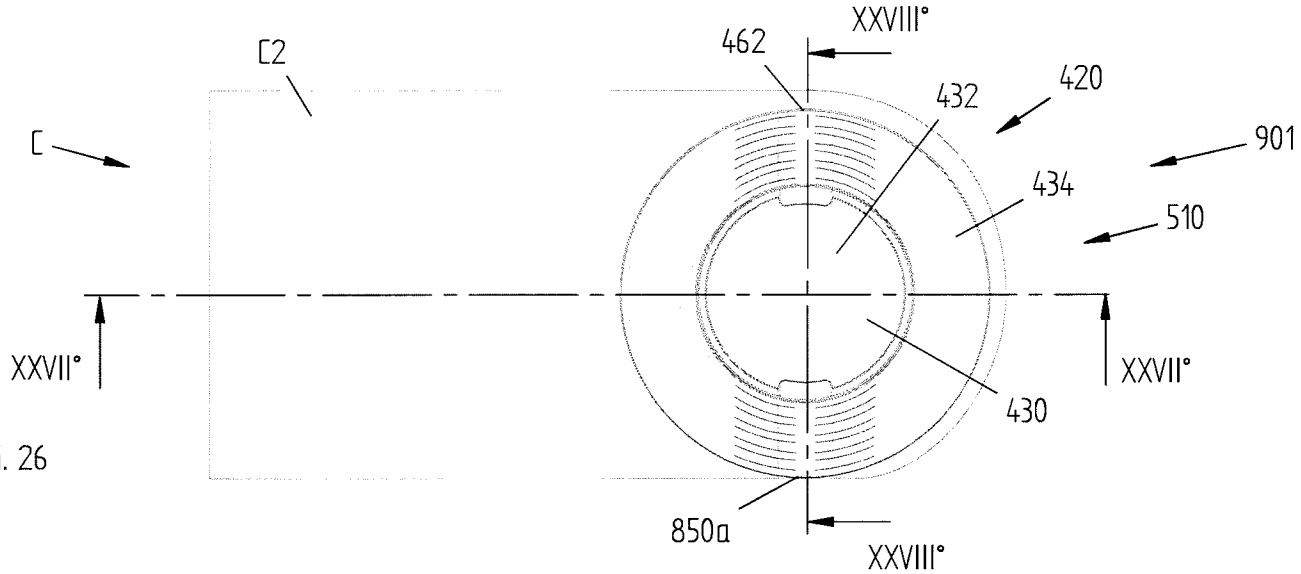
FIG. 26 shows a top plan view of FIG. 25.

The sealing element S constitutes a removable portion, preferably a tear-off portion, suited to be removed before the dispensing system 701 is used for the first time. FIGS. 23 and 24 show a variant embodiment 801 of the dispensing system of the invention, which differs from the embodiments of the dispensing system for dispensing two fluids described above in that one of the two fluids is air and in that the outlet ducts are shaped in such a way as to allow the fluids to be mixed, that is, fluid plus air, so as to obtain the formation of foam.

As can be inferred from the figures, the upper portion of the dispensing system 801, according to the details described above, allows a first fluid L1 contained in the container C to be dispensed through the outlet duct 64 with the respective second valve means 68.

The lower portion of the dispensing system 801 comprises the second collapsible chamber 420 with the respective third portion 430, which allows the second fluid consisting of air sucked in through the second inlet duct 462 to be dispensed. The air sucked in through the second inlet duct 462 is conveyed to the outlet duct 464 through the respective second valve means 468.

Downstream of the first and of the second outlet duct 64, 464 there are a chamber 850 and an element 850*a* for the formation of foam. Said element 850*a* preferably comprises a hollow cylindrical element whose external surface is provided with microholes, or with a net, for the generation of foam.

According to the preferred embodiment described herein, the inlet duct 62 and the outlet duct 64 for the first fluid L1 and the inlet duct 462 and the outlet duct 464 for the second fluid L2, that is, air, are aligned along the same direction.

Figure 28:
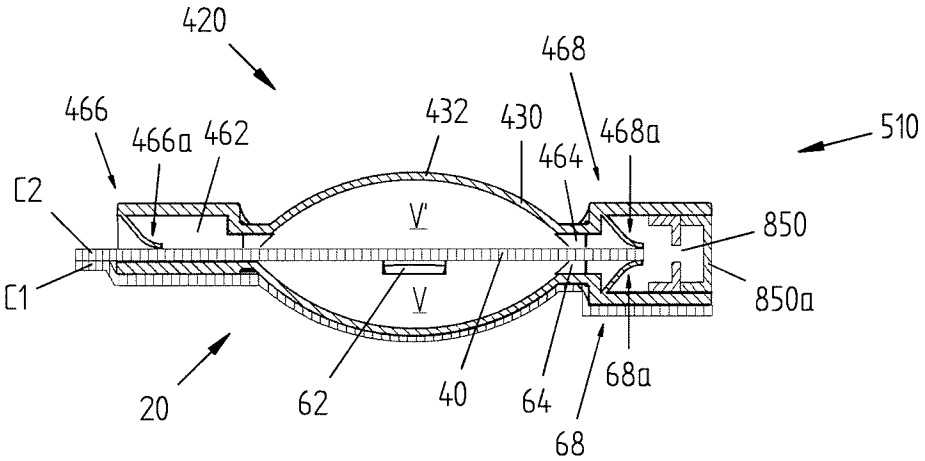
FIG. 28 shows the sectional view of FIG. 26 according to line XXVIII°-XXVIII.
Figure 29:
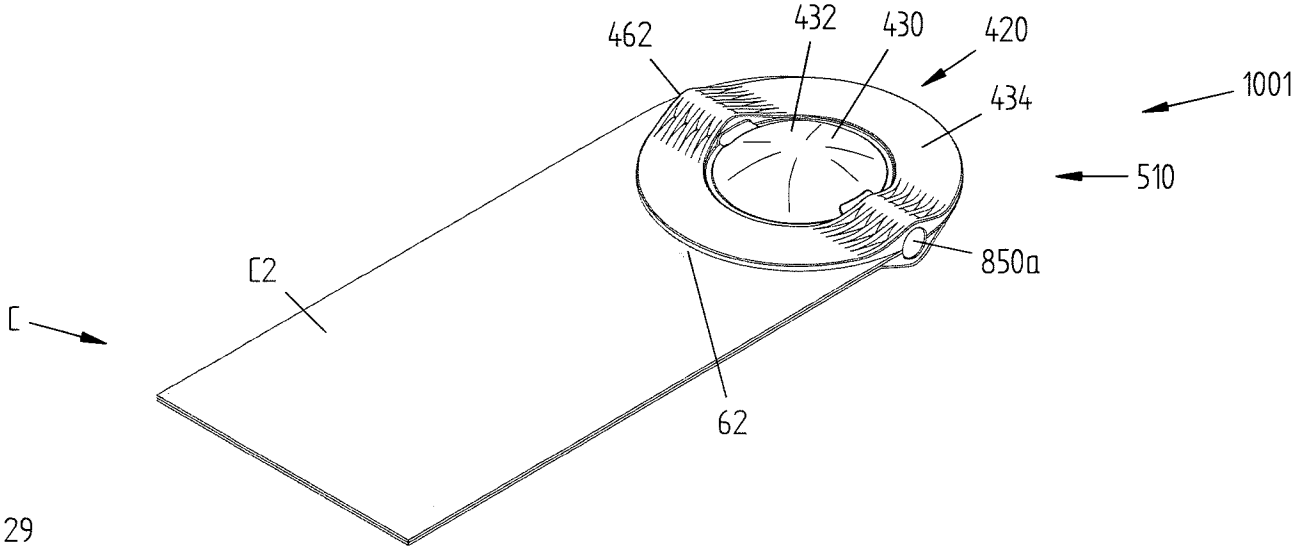
FIG. 29 shows an axonometric view of the dispensing system shown in FIG. 25 according to another embodiment of the invention.
Figure 30:
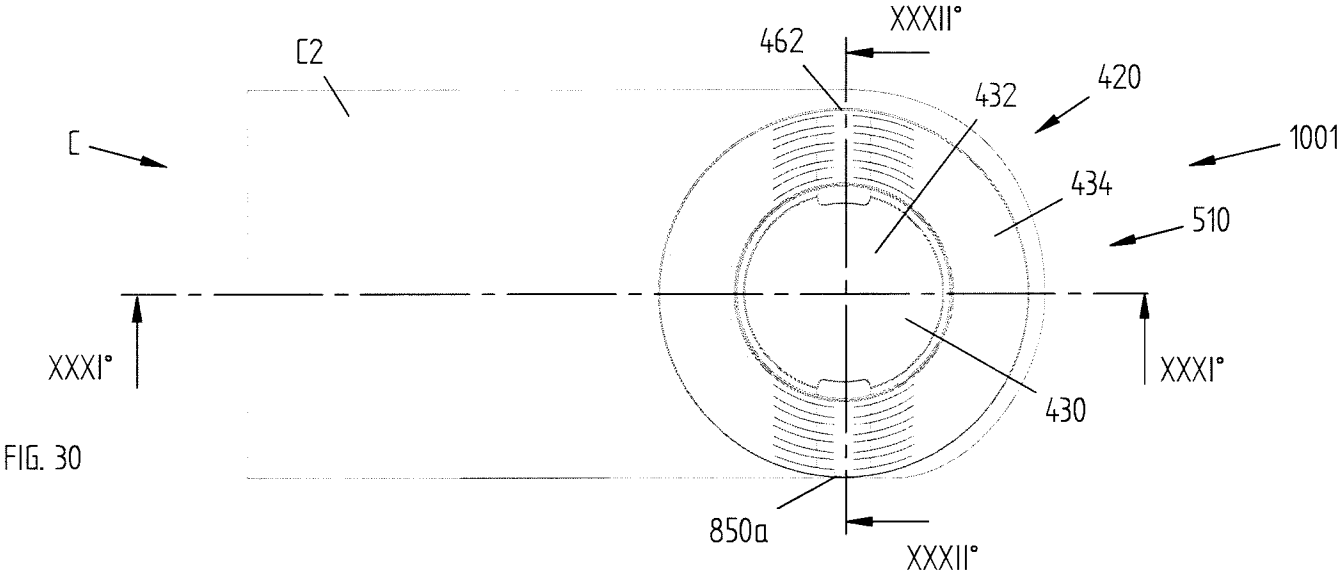
FIG. 30 shows a top plan view of FIG. 29.
Figure 31:
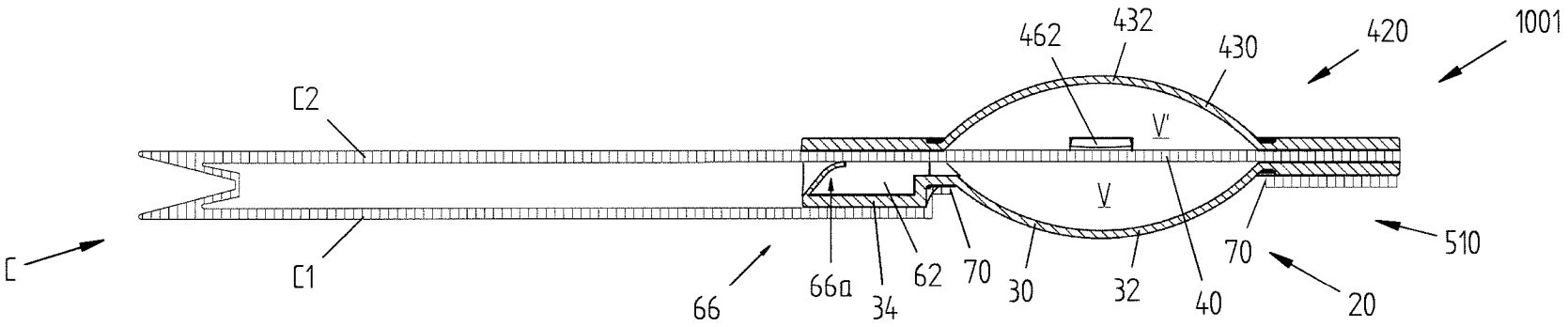
FIG. 31 shows the sectional view of FIG. 30 according to line XXXI-XXXI.
Figure 32:
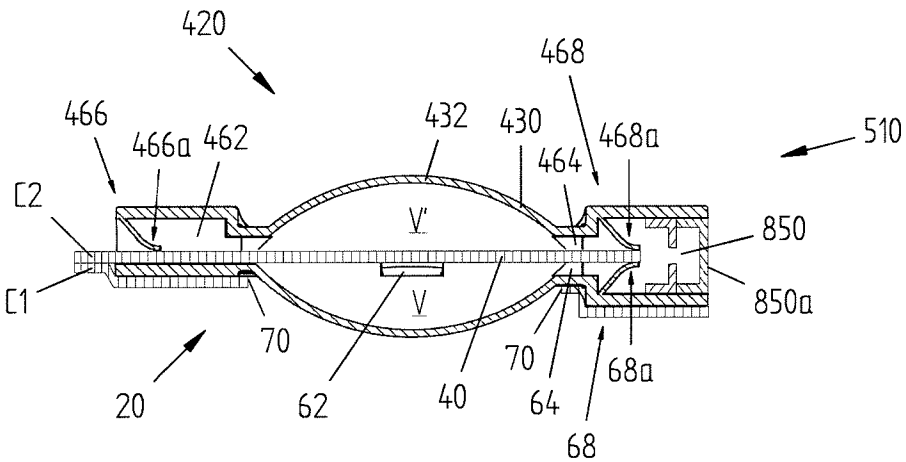
FIG. 32 shows the sectional view of FIG. 30 according to line XXXII-XXXII.
Figure 33:
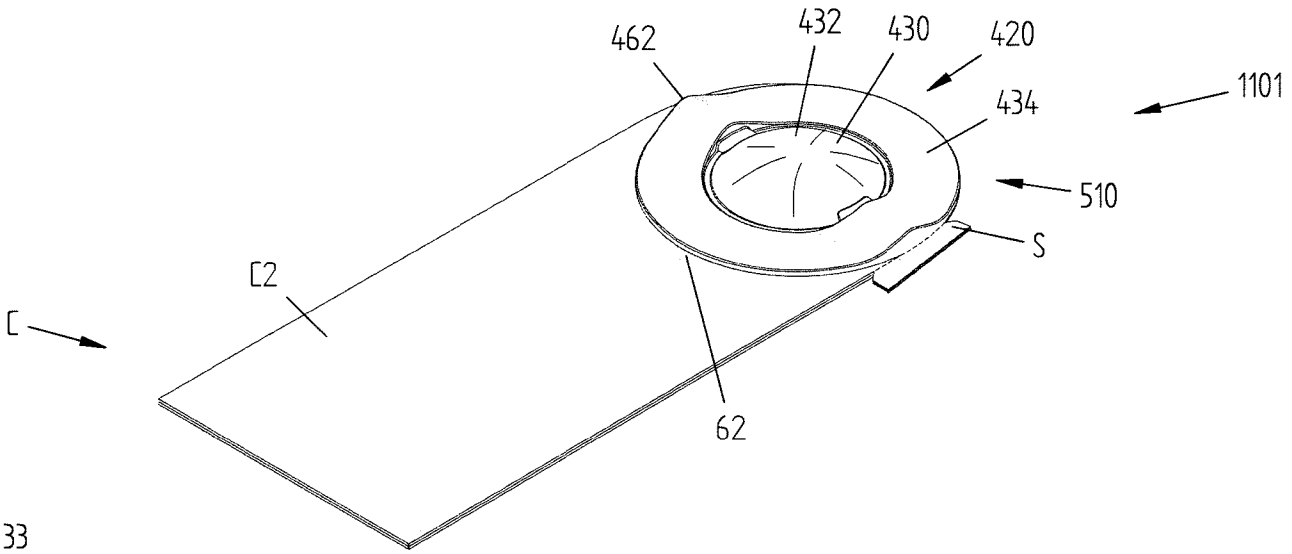
FIG. 33 shows an axonometric view of the dispensing system shown in FIG. 29 according to another embodiment of the invention.
Figure 34:
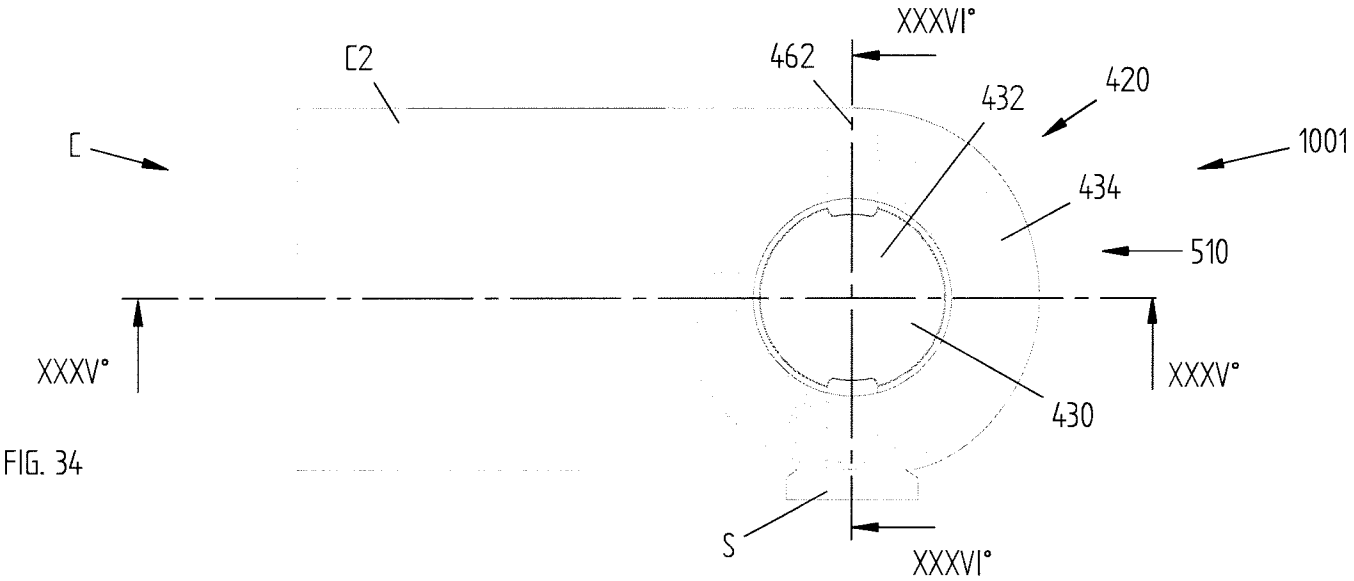
FIG. 34 shows a top plan view of FIG. 33.
Figure 35:
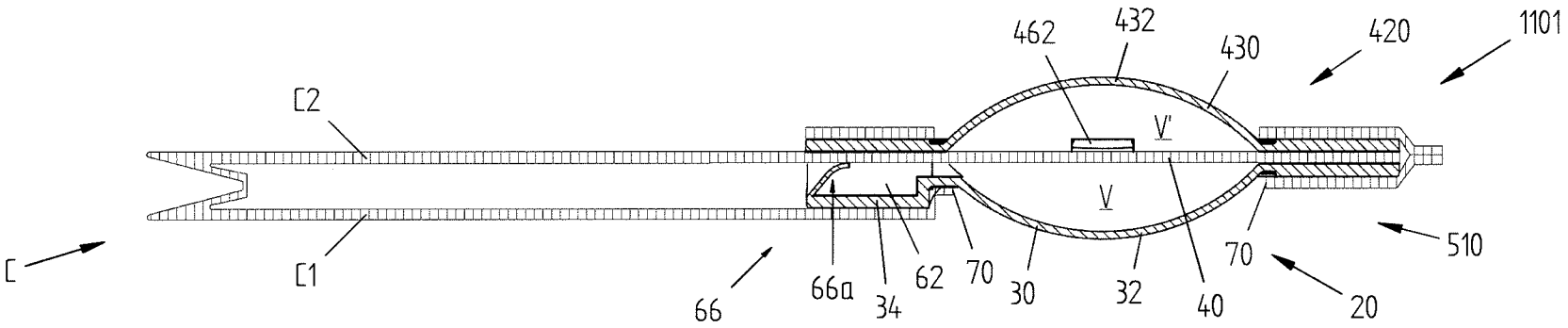
FIG. 35 shows the sectional view of FIG. 34 according to line XXXV-XXXV.
Figure 36:
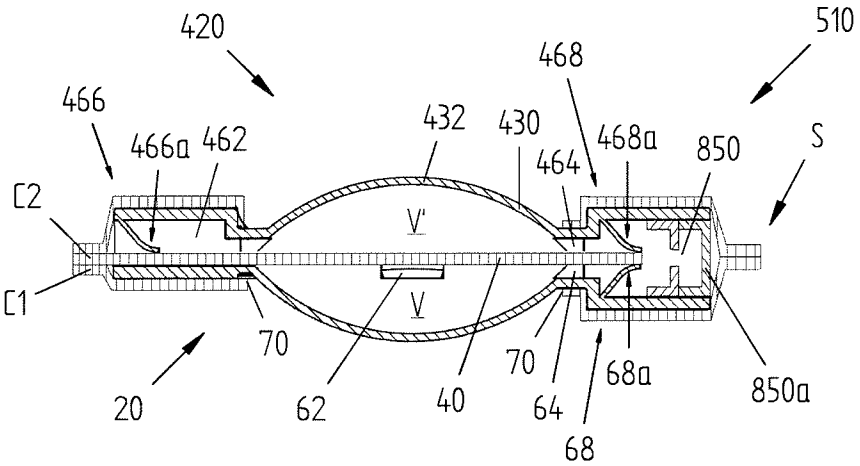
FIG. 36 shows the sectional view of FIG. 34 according to line XXXVI-XXXVI.

Figures from 25 to 28 show a variant embodiment 901 of the dispensing system of the invention, which differs from the embodiment 801 of the dispensing system described with reference to FIGS. 23 and 24 in that in the dispensing device 510 the inlet duct 462 and the outlet duct 464 for the second fluid L2, that is, air, and the outlet duct 64 for the first fluid L1 are aligned along the same direction, while the inlet duct 62 for the first fluid L1 is perpendicular to said ducts, as can be observed in particular in FIG. 28.

Figure 27:
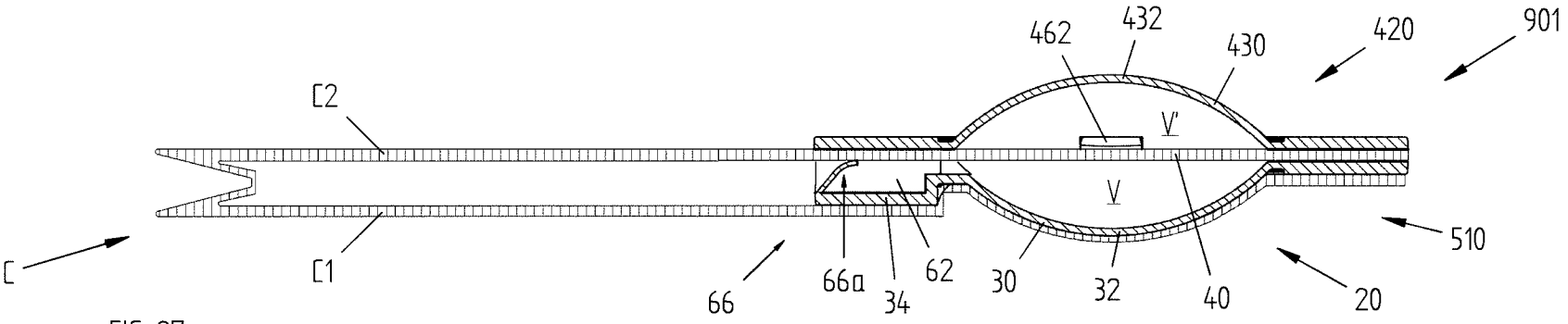
FIG. 27 shows the sectional view of FIG. 26 according to line XXVII-XXVII.

It should be noted that the portion C1 of the container C completely envelops the first portion 30 of the dispensing device 10, which is visible in greater detail in FIG. 27.

Figures from 29 to 32 show a variant embodiment 1001 of the dispensing system of the invention, which differs from the embodiment 901 of the dispensing system described with reference to Figures from 25 to 28 in that the portion C1 of the container C envelops peripherally the first portion 30 of the collapsible chamber 20 and is provided with a hole 70 in order to allow the elastically yielding centre area 32 of the first portion 30 to project therefrom.

Figures from 33 to 36 show a variant embodiment 1101 of the dispensing system of the invention, which differs from the embodiment 1001 of the dispensing system described with reference to Figures from 29 to 32 in that it furthermore comprises a sealing element S associated with the container C and arranged at the level of the element 850*a* for the formation of foam.

The sealing element S constitutes a removable portion, preferably a tear-off portion, suited to be removed before the dispensing system 1101 is used for the first time.

Figure 37:
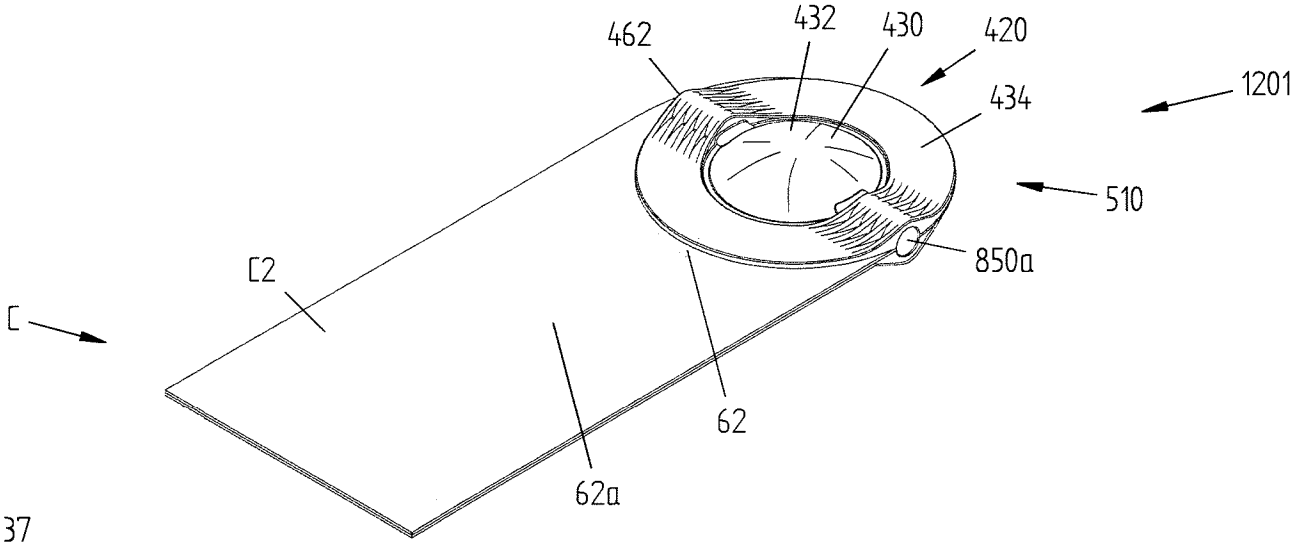
FIG. 37 shows an axonometric view of the dispensing system shown in FIG. 25 according to another embodiment of the invention.

FIG. 37 shows a variant embodiment 1201 of the dispensing system of the invention, which differs from the embodiment 901 of the dispensing system described with reference to Figures from 25 to 28 in that the inlet duct 62 is preferably associated with a suction pipe 62*a* whose predetermined length is such that it substantially terminates in proximity to the bottom of the container C. This makes it easier to draw the first fluid L1 from the bottom of the container C.

According to the above, it can be understood that the dispensing device that is the subject of the invention has a simplified structure compared to the devices of the known type, with consequently reduced production times and/or costs of the device itself and of the system in general.

The reduced number of elements makes it possible to achieve higher reliability and efficiency compared to the devices of the known type.

The reduced number of elements, furthermore, makes it possible to manufacture a dispensing device with reduced overall dimensions and reduced weight compared to the devices of the known type.

It has thus been shown that the present invention allows the set objects to be achieved. More specifically, it makes it possible to manufacture a system for dispensing fluids whose structure is simplified compared to the systems of the known type.

While the present invention has been described with reference to the specific embodiments shown in the figures, it should be noted that the present invention is not limited to the specific embodiments illustrated and described herein. These and other variants of the embodiments described herein fall within the scope of the present invention, which is defined in the claims.

The invention claimed is:

1. A system for dispensing a fluid, comprising a container configured to contain said fluid and a device configured to dispense said fluid said device comprising:

a collapsible chamber which defines a volume configured to receive a quantity of said fluid to be dispensed, said collapsible chamber being at least partially defined by a first portion having an area connected to said container and a second portion constituted by a portion of said container, said first and second portions of the chamber being mutually coupled together to define said volume, an inlet duct, and an outlet duct;

wherein the inlet duct configured to allow the passage of said fluid from the inside of said container towards said volume;

first valve means configured to control the passage of said fluid into said inlet duct;

wherein the outlet duct for said fluid configured to allow the passage of said fluid from said volume towards the outside;

second valve means configured to control the passage of said fluid into said outlet duct, and wherein said container comprises a first portion connected to and completely enveloping said first portion of said device and a second portion which defines said second portion of said device.

2. A system according to claim 1, wherein said portion of said container comprises a flexible film.

3. A system according to claim 1, wherein said collapsible chamber is defined by at least one elastically yielding area of said first portion.

4. A system according to claim 1, wherein said first portion comprises an elastically yielding center area and an annular peripheral area from which said center area extends.

5. A system according to claim 4, wherein said area of said first portion connected to said container corresponds to said annular peripheral area.

6. A system according to claim 1, wherein said first portion and said container portion are mutually coupled with each other through a heat sealing operation.

7. A system according to claim 1, wherein said first portion is coupled with said container through a heat sealing operation.

8. A system according to claim 1 wherein said first portion of said container comprises a flexible film and said second portion of said container comprises a flexible film.

9. A system according to claim 1, wherein said inlet duct and/or said outlet duct is/are defined between said first portion and said second portion.

10. A system according to claim 1, wherein said inlet duct and said outlet duct are aligned along the same direction.

11. A system for dispensing a fluid, comprising a container configured to contain said fluid and a device configured to dispense said fluid said device comprising:

a collapsible chamber which defines a volume configured to receive a quantity of said fluid to be dispensed, said collapsible chamber being at least partially defined by a first portion having an area connected to said container and a second portion constituted by a portion of said container, said first and second portions of the chamber being mutually coupled together to define said volume, an inlet duct, and an outlet duct;

wherein the inlet duct configured to allow the passage of said fluid from the inside of said container towards said volume;

first valve means configured to control the passage of said fluid into said inlet duct;

wherein the outlet duct for said fluid configured to allow the passage of said fluid from said volume towards the outside;

second valve means configured to control the passage of said fluid into said outlet duct, wherein said container is configured to receive a second fluid and in that said device further comprises:

a second collapsible chamber which defines a second volume configured to receive a quantity of said second fluid to be dispensed;

a second inlet duct configured to allow the passage of said second fluid from the inside of said container towards said second volume;

first valve means configured to control the passage of said second fluid into said second inlet duct;

a second outlet duct for said second fluid configured to allow the passage of said second fluid from said second volume towards the outside;

second valve means configured to control the passage of said second fluid into said second outlet duct, wherein said second collapsible chamber is at least partially defined by a third portion and by said second portion mutually coupled together to define said second volume, said second inlet duct, and said second outlet duct, wherein said third portion comprises an area connected to said container.

* * * * *